US011497378B2

(12) United States Patent
Jung et al.

(10) Patent No.: US 11,497,378 B2
(45) Date of Patent: Nov. 15, 2022

(54) DISH WASHING MACHINE AND METHOD OF CONTROLLING THE SAME

(71) Applicant: SAMSUNG ELECTRONICS CO., LTD., Suwon-si (KR)

(72) Inventors: Min Kyung Jung, Suwon-si (KR); Yoo Jin Kang, Seoul (KR); In Ju Lee, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 577 days.

(21) Appl. No.: 16/475,936

(22) PCT Filed: Oct. 30, 2017

(86) PCT No.: PCT/KR2017/012072
§ 371 (c)(1),
(2) Date: Jul. 3, 2019

(87) PCT Pub. No.: WO2018/128258
PCT Pub. Date: Jul. 12, 2018

(65) Prior Publication Data

US 2019/0343367 A1 Nov. 14, 2019

(30) Foreign Application Priority Data

Jan. 3, 2017 (KR) ..... 10-2017-0000918

(51) Int. Cl.
*A47L 15/42* (2006.01)
*A47L 15/50* (2006.01)

(52) U.S. Cl.
CPC ..... *A47L 15/4295* (2013.01); *A47L 15/4278* (2013.01); *A47L 15/50* (2013.01);
(Continued)

(58) Field of Classification Search
CPC ..... A47L 15/4278; A47L 15/4295
See application file for complete search history.

(56) References Cited

U.S. PATENT DOCUMENTS 6,463,940 B1 * 10/2002 Thomas ..... A47L 15/0055 134/113
6,643,940 B1 11/2003 Donath et al.
(Continued)

FOREIGN PATENT DOCUMENTS

CN 1988839 A 6/2007
CN 105899114 A 8/2016
(Continued)

OTHER PUBLICATIONS

Written Opinion of the International Searching Authority dated Feb. 20, 2018 in corresponding International Patent Application No. PCT/KR2017/012072.
(Continued)

*Primary Examiner* — Joseph L. Perrin
*Assistant Examiner* — Kevin G Lee
(74) *Attorney, Agent, or Firm* — Staas & Halsey LLP

(57) ABSTRACT

A dish washing machine includes a door, a main body in which a washing tub for opening and closing the front opening of the door is provided, and a basket configured to be installed in the washing tub to be able to move in and out of the washing tub and to contain dishes. A sensing unit is configured to sense a basket identifier and a door identifier. A driving unit is configured to drive a vane. A controller is configured to control the driving unit such that cleaning is performed for each dish storage area of the basket based on the sensed result of a sensing unit. The controller determines the area where the dishes are laid, and controls the driving unit to clean the dish storage area where the dishes are laid.

8 Claims, 23 Drawing Sheets

(52) U.S. Cl.
CPC ..... *A47L 2401/04* (2013.01); *A47L 2401/30* (2013.01); *A47L 2501/02* (2013.01)

(56) References Cited

U.S. PATENT DOCUMENTS

| | | | | |
|---|---|---|---|---|
| 8,696,827 | B2 | 4/2014 | Ashrafzadeh et al. | |
| 2012/0138092 | A1* | 6/2012 | Ashrafzadeh | A47L 15/4295 134/57 D |
| 2016/0324396 | A1* | 11/2016 | Hong | A47L 15/16 |

FOREIGN PATENT DOCUMENTS

| | | | |
|---|---|---|---|
| CN | 106028896 | A | 10/2016 |
| EP | 1 192 893 | A2 | 4/2002 |
| EP | 1 925 250 | A1 | 5/2008 |
| EP | 2 030 556 | A1 | 3/2009 |
| EP | 3 090 674 | A1 | 11/2016 |
| KR | 10-2010-0052208 | | 5/2010 |
| KR | 10-1071831 | | 10/2011 |
| KR | 10-2015-0079221 | | 7/2015 |

OTHER PUBLICATIONS

International Search Report dated Feb. 20, 2018 in corresponding International Patent Application No. PCT/KR2017/012072.
Extended European Search Report dated Aug. 22, 2019 in corresponding European Patent Application No. 17890488.4.
Chinese Office Action dated May 7, 2022 in Chinese Patent Application No. 201780087796.0.

* cited by examiner

FIG.4A
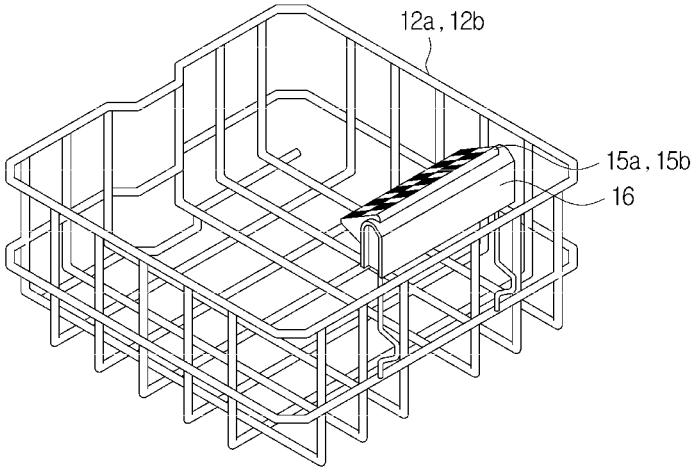
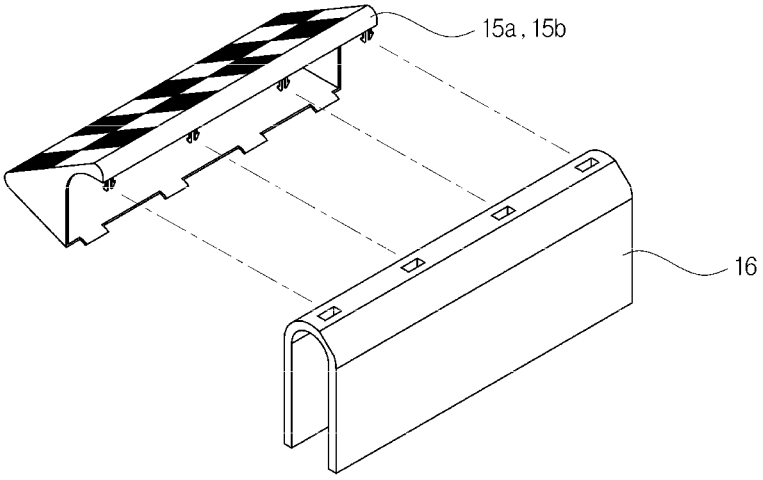

FIG.18

| | | LEFT | RIGHT |
|---|---|---|---|
| AII(C) | AFTER | A1 | A2 |
| | BEFORE | A3 | A4 |

| CASE | | A1 | A3 | A2 | A4 |
|---|---|---|---|---|---|
| CASE 1 | 1-1 | ○ | × | × | × |
| | 1-2 | × | ○ | × | × |
| | 1-3 | × | × | ○ | × |
| | 1-4 | × | × | × | ○ |
| CASE 2 | 2-1 | ○ | ○ | × | × |
| | 2-2 | × | × | ○ | ○ |
| CASE 3 | 3-1 | ○ | × | ○ | × |
| | 3-2 | × | ○ | × | ○ |
| CASE 4 | 4-1 | ○ | × | × | ○ |
| | 4-2 | × | ○ | ○ | × |
| CASE 5 | 5-1 | ○ | ○ | ○ | × |
| | 5-2 | ○ | ○ | × | ○ |
| | 5-3 | ○ | × | ○ | ○ |
| | 5-4 | × | ○ | ○ | ○ |
| CASE 6 | 6 | ○ | ○ | ○ | ○ |
| CASE 7 | 7 | × | × | × | × |

| 1 | | 2 | |
|---|---|---|---|
| VANE DRIVE | LEFT/RIGHT SPRAY | VANE DRIVE | LEFT/RIGHT SPRAY |
| VANE BACK | LEFT | | |
| VANE FRONT | LEFT | | |
| VANE BACK | RIGHT | | |
| VANE FRONT | RIGHT | | |
| VANE ALL | LEFT | | |
| VANE ALL | RIGHT | | |
| VANE BACK | ALL | | |
| VANE FRONT | ALL | | |
| VANE BACK | LEFT | Vane front | RIGHT |
| VANE BACK | RIGHT | VANE FRONT | LEFT |
| VANE ALL | LEFT | VANE BACK | RIGHT |
| VANE ALL | LEFT | VANE FRONT | RIGHT |
| VANE BACK | LEFT | VANE ALL | RIGHT |
| VANE FRONT | LEFT | VANE ALL | RIGHT |
| VANE ALL | ALL | | |
| × | × | | |

FIG.19

| | DISH STORAGE | | WASH |
|---|---|---|---|
| | UPPER BASKET | LOWER BASKET | |
| CASE 1 | × | × | - |
| CASE 2 | ○ | × | UPPER |
| CASE 3 | × | ○ | LOWER (WASHING BY AREA) |
| CASE 4 | ○ | ○ | UPPER & LOWER (WASHING BY AREA) |

DISH WASHING MACHINE AND METHOD OF CONTROLLING THE SAME

CROSS-REFERENCE TO RELATED APPLICATIONS

This application is a U.S. National Stage Application which claims the benefit under 35 U.S.C. § 371 of International Patent Application No. PCT/KR2017/012072 filed on Oct. 30, 2017, which claims foreign priority benefit under 35 U.S.C. § 119 of Korean Patent Application No. 10-2017-0000918 filed on Jan. 3, 2017 in the Korean Intellectual Property Office, the contents of both of which are incorporated herein by reference.

TECHNICAL FIELD

Embodiments of the disclosure relate to a dish washing machine capable of shortening the time for washing by selectively cleaning an area in which dishes are placed, and a method of controlling the same.

BACKGROUND ART

A dish washing machine includes a main body provided with a washing tub therein, a basket for accommodating dishes, a sump for storing washing water, a nozzle for spraying the washing water, and a circulation pump for supplying the washing water in the sump to the nozzle. The dish washing machine is a household appliance that washes dishes by spraying high pressure washing water to the dishes.

In order to quickly perform processes such as washing and rinsing, an area in which dishes are accommodated and an area in which dishes are not accommodated need to be distinguished such that the processes such as the washing and the rinsing are performed in the area in which the dishes are accommodated. However, in the conventional dish washing machines, washing, rinsing, and the like are performed even on an area in which dishes are not accommodated, and are also performed without sensing the position in which dishes are accommodated by only sensing the accommodation of the dishes, which increases the washing time and decreases the washing power. Accordingly, it is required to perform an appropriate operation to solve the problem.

DISCLOSURE

Technical Problem

Therefore, it is an aspect of the disclosure to provide a dish washing machine for sensing an area in which dishes are accommodated and supplying washing water to the area in which the dishes are accommodated, and a method of controlling the same.

Technical Solution

In accordance with an aspect of the disclosure, a dish washing machine may include a door configured to being attached to a door identifier; a main body in which a washing tub for opening and closing a front opening of the door is provided; a basket configured to be installed in the washing tub to be able to be inserted into or drawn out of the washing tub and contain dishes and have a basket identifier; a sensing unit configured to sense the basket identifier and the door identifier; a plurality of nozzles for spraying washing water; a vane configured to reflect the sprayed washing water in the washing tub; a driving unit configured to drive the vane; and a controller configured to control the driving unit such that cleaning is performed for each dish storage area of the basket based on the sensed result of the sensing unit, wherein the controller may determine the area where the dishes are laid, and controls the driving unit to clean the dish storage area where the dishes were laid.

Further, the basket identifier and the door identifier each may include a color or a pattern distinguished by the controller.

Further, the basket identifier may be provided in front of the basket, and the door identifier may be provided on an inner side surface of the door.

Further, the sensing unit may include a camera provided at an upper end of the main body to take pictures of the front of the main body, and the controller may generate position information of the basket identifier and a portion of the door identifier that are overlapped with each other based on the detected result of the sensing unit, the position information of the portion of the door identifier that is overlapped may include an x-coordinate from one end of the door to the portion of the door identifier that is overlapped, the position information of the basket identifier may include a y-coordinate indicating a distance from the front opening of the washing tub to the basket identifier, and the position information of the door identifier may include width information of the overlapped portion of the door identifier.

Further, the controller may determine a plurality of the dish storage areas where the dishes are laid.

Further, the dish washing machine may further include a sump configured to store the washing water; and a dispensing device configured to supply the washing water stored in the sump to the plurality of nozzles, and the driving unit may activate the dispensing device according to a control signal of the controller, and the controller may control the driving unit such that the nozzle corresponding to the dish storage area where the dishes are laid among the plurality of nozzles sprays the washing water to the dish storage area where the dishes are laid.

Further, the plurality of nozzles may be fixed to a lower side of the washing tub, and the vane may perform a linear reciprocating motion along the spraying direction of the plurality of nozzles by driving the driving unit.

In accordance with an aspect of the disclosure, a method for controlling a dish washing machine comprising a plurality of nozzles, a vane for reflecting washing water sprayed from the plurality of nozzles, and a driving unit for driving the vane, the method may include detecting a basket identifier attached to a basket for storing dishes; detecting a door identifier attached to a door; and controlling the driving unit to perform cleaning for each dish storage area of the basket based on the detection result of the detecting step, and the step of controlling the driving unit may include the steps of determining the dish storage area in which the dishes are stored and controlling the driving unit to clean the dish storage area in which the dishes are stored.

Further, the step of determining the dish storage area in which the dishes are stored may include generating position information of the basket identifier and a portion of the door identifier that are overlapped with each other based on the detected result, and the position information of the portion of the door identifier that is overlapped may include an x-coordinate from one end of the door to the portion of the door identifier that is overlapped, the position information of the basket identifier may include a y-coordinate indicating a distance from the front opening of the washing tub to the basket identifier, and the position information of the door identifier may include width information of the overlapped portion of the door identifier.

Further, the basket may include an upper basket and a lower basket, and before the step of detecting the door identifier, the method may determine whether the upper basket is taken out or pushed in based on the detection result of the basket identifier of the upper basket, and may determine whether the lower basket is carried out or carried in based on the result of detection of the basket identifier of the lower basket.

Further, before the step of detecting the door identifier, the method may further determine that the basket is carried in, and the basket identifier and the door identifier each may include a color or a pattern distinguished from each other.

Further, the dish washing machine may further include a dispensing device configured to supply the washing water stored to the plurality of nozzles, and controlling the driving unit to perform cleaning for each of the dish storage areas of the basket based on the detection result of the detecting step may include controlling the driving unit to activate the dispensing device such that the nozzle corresponding to the dish storage area where the dishes are laid among the plurality of nozzles sprays the washing water to the dish storage area where the dishes are laid and supplying the washing water by driving the dispensing device to the dish storage area where the dishes are laid by the driving unit.

Further, the dish washing machine may further include a camera provided at an upper end of the main body to take pictures of the front of the main body, and detecting the basket identifier may include detecting the basket identifier by the camera; and detecting the door identifier may include detecting the door identifier by the camera.

Advantageous Effects

As is apparent from the above description, as the washing water is supplied intensively to the area in which the dishes are placed, the washing power of the dishes can be increased.

Also, as is apparent from the above description, as the washing water is selectively supplied to the area in which the dishes are stored, the execution time of the process such as washing or rinsing can be shortened.

DESCRIPTION OF DRAWINGS

FIGS. 4A and 4B are external views of a basket of the dish washing machine in accordance with one embodiment and another embodiment.

FIG. 18 is a schematic diagram illustrating an algorithm for driving the vane and a dispensing device when dishes are placed in each dish storage area of the lower basket.

FIG. 19 is a schematic view for explaining a method of performing washing control according to whether dishes are placed in an upper basket or the lower basket.

BEST MODE

Mode for Invention

Figure 1:
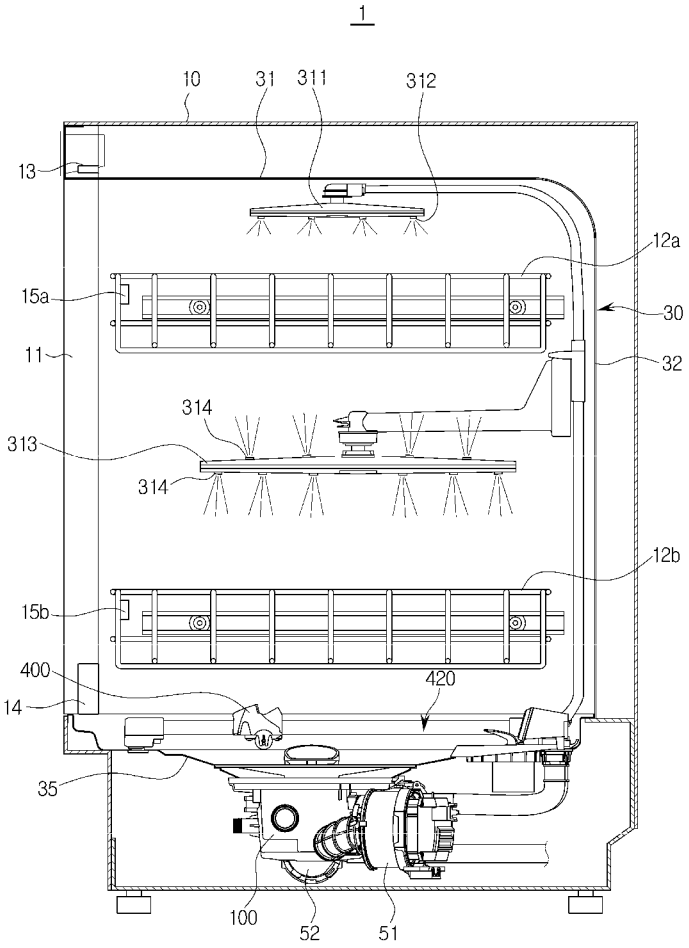
FIG. 1 is a cross-sectional view of a dish washing machine in accordance with an embodiment of the disclosure.

Reference will now be made in detail to the embodiments of the present disclosure, examples of which are illustrated in the accompanying drawings, wherein like reference numerals refer to like elements throughout. This specification does not describe all elements of the embodiments of the present disclosure and detailed descriptions on what are well known in the art or redundant descriptions on substantially the same configurations may be omitted. The terms 'unit, module, member, and block' used herein may be implemented using a software or hardware component. According to an embodiment, a plurality of 'units, modules, members, or blocks' may also be implemented using an element and one 'unit, module, member, or block' may include a plurality of elements.

Throughout the specification, when an element is referred to as being "connected to" another element, it may be directly or indirectly connected to the other element and the "indirectly connected to" includes being connected to the other element via a wireless communication network.

Also, it is to be understood that the terms "include" and "have" are intended to indicate the existence of elements disclosed in the specification, and are not intended to preclude the possibility that one or more other elements may exist or may be added.

Throughout the specification, when a member is located "on" another member, this includes not only when a member is in contact with another member but also when another member is present between the two members.

In this specification, terms "first," "second," etc. are used to distinguish one component from other components and, therefore, the components are not limited by the terms.

An expression used in the singular encompasses the expression of the plural, unless it has a clearly different meaning in the context.

The reference numerals used in operations are used for descriptive convenience and are not intended to describe the order of operations and the operations may be performed in a different order unless otherwise stated.

Hereinafter, embodiments of the present disclosure will be described in detail with reference to the accompanying drawings.

First, after describing the structure of a dish washing machine in accordance with the embodiment of the disclosure, the operation of the dish washing machine will be described on the basis thereof.

Figure 2:
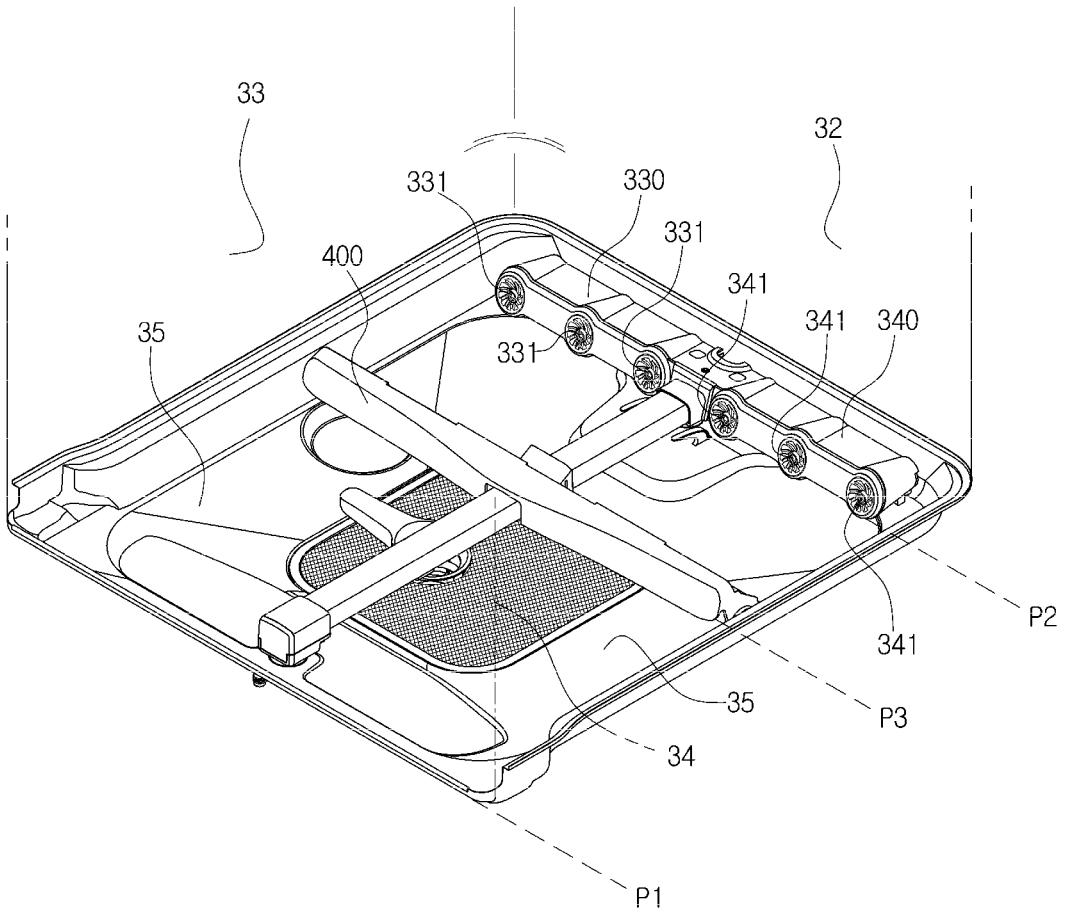
FIG. 2 is a bottom view of the dish washing machine of FIG. 1.
Figure 3:
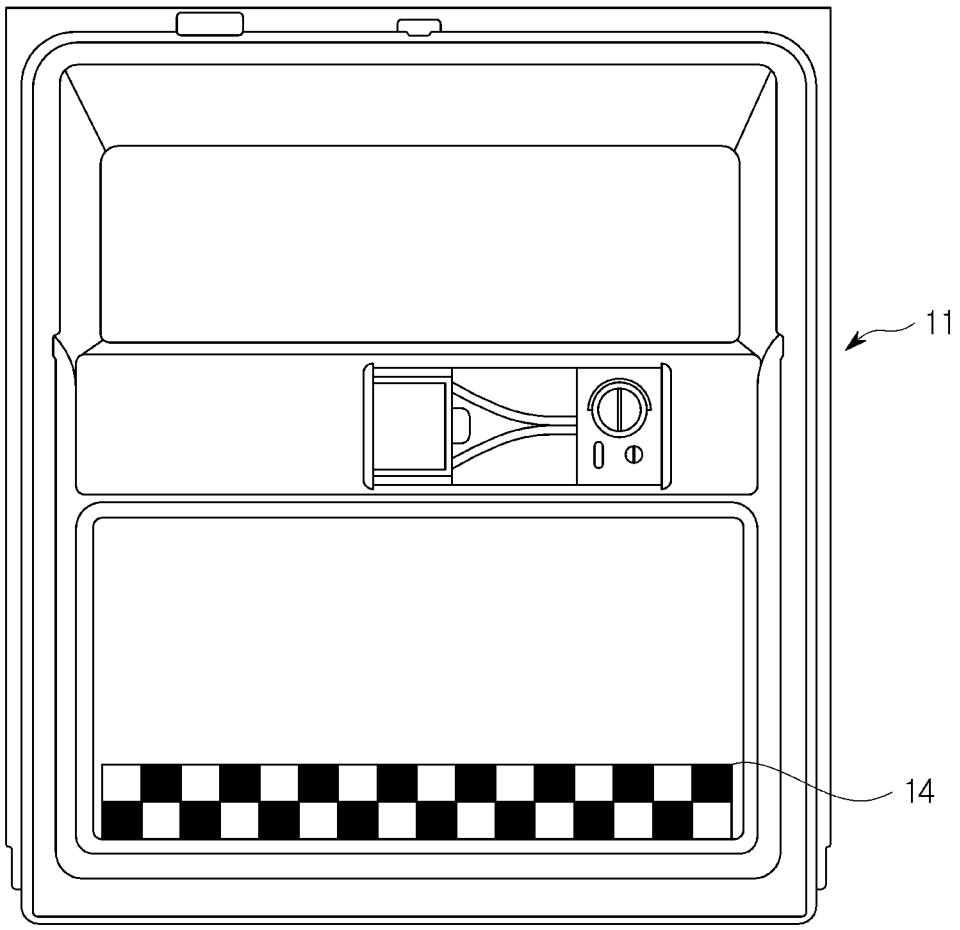
FIG. 3 is an interior view of a door of the dish washing machine in accordance with an embodiment of the disclosure.
Figure 4B:
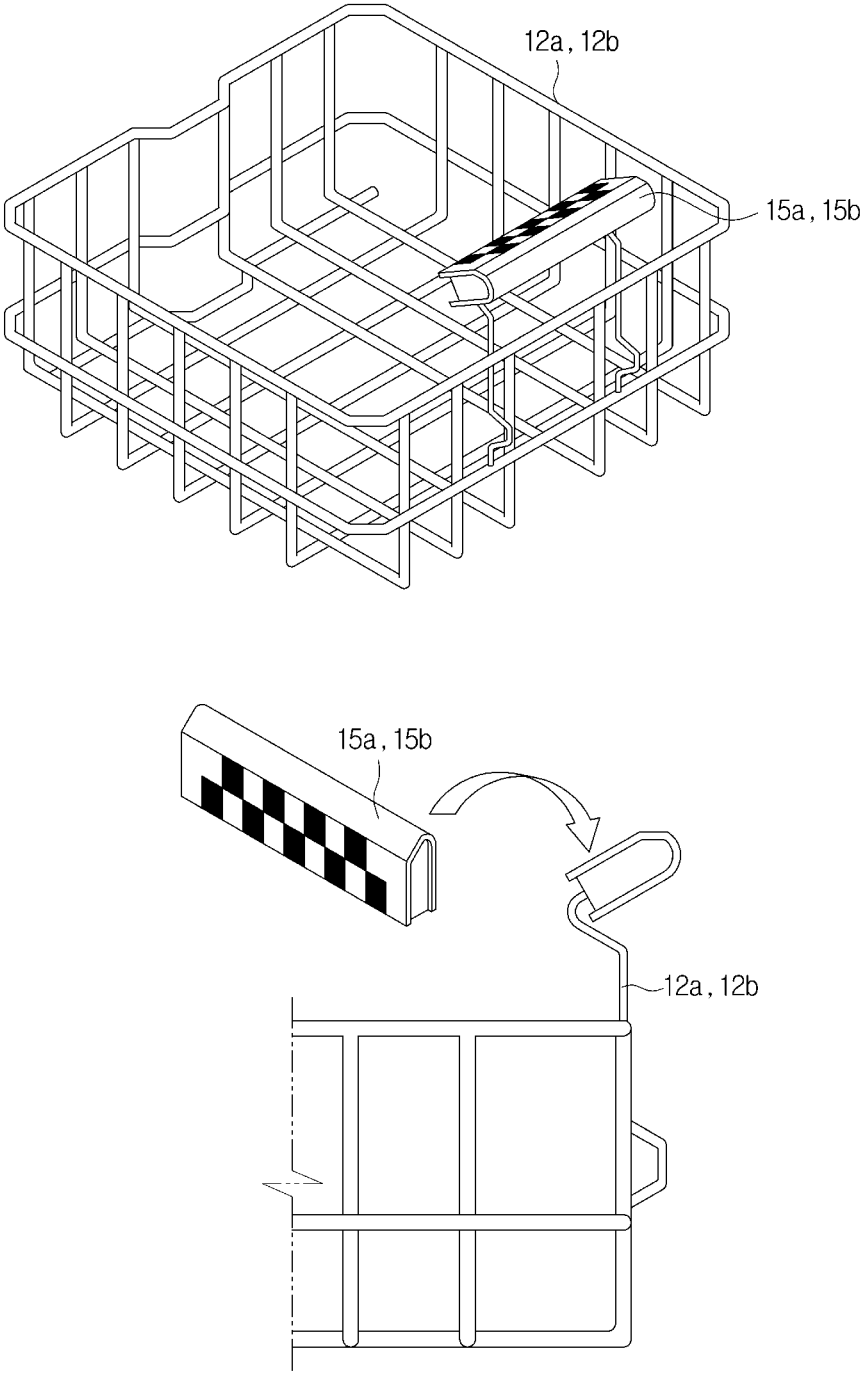

FIG. 1 is a cross-sectional view of a dish washing machine in accordance with an embodiment of the disclosure, FIG. 2 is a bottom view of the dish washing machine of FIG. 1, FIG. 3 is an interior view of a door of the dish washing machine in accordance with an embodiment of the disclosure, and FIGS. 4A and 4B are external views of a basket of the dish washing machine in accordance with one embodiment and another embodiment.

A dish washing machine 1 may include a main body 10 which forms an exterior, a washing tub 30 provided in the main body 10, baskets 12*a* and 12*b* provided in the washing tub 30 to store dishes, a camera 13 provided at an upper end of the main body 10 to detect the access of the baskets 12*a* and 12*b* and the dishes stored in the baskets 12*a* and 12*b*, nozzles 311, 313, 330, and 340 for spraying washing water, a sump 100 for storing the washing water, a circulation pump 51 for pumping the washing water of the sump 100 to supply it to the nozzles 311, 313, 330, and 340, a drain pump 52 for discharging the washing water of the sump 100 to the outside of the main body 10 together with foreign matter, a vane 400 which moves inside the washing tub 30 and reflects the washing water to a dish side, and a driving device 420 for driving the vane 400.

The washing tub 30 is formed in an approximate box shape and has an open front for putting in or taking out dishes and includes a top wall 31, a rear wall 32, a left-side wall 33, a right-side wall 34, and a bottom plate 35. The open front of the washing tub 30 may be opened and closed by a door 11.

Referring to FIG. 3, on the inner side of the door 11, a door identifier 14 detected by the camera 13 at the time of opening may be provided. The door identifier 14 may have a color or a shape different from the background of the door 11.

Referring to FIGS. 4A and 4B, the baskets 12*a* and 12*b* can be constructed of wire racks made of wires such that the washing water can pass without being stayed. The baskets 12*a* and 12*b* may be detachably installed inside of the washing tub 30. When the baskets 12*a* and 12*b* are installed inside the washing tub 30, the baskets 12*a* and 12*b* slide in the direction of the door 11 and can go inside and outside of the washing tub 30. The baskets 12*a* and 12*b* may include the upper basket 12*a* disposed at an upper portion of the washing tub 30 and the lower basket 12*b* disposed at a lower portion of the washing tub 30.

Basket identifiers 15*a* and 15*b* may be provided on the upper basket 12*a* and the lower basket 12*b* to be detected by the camera 13 when the baskets 12*a* and 12*b* are taken out. The upper basket identifier 15*a* of the upper basket 12*a* and the lower basket identifier of the lower basket 12*b* may have a color or a shape that are distinguished from each other and separated from the background. The identifier 15*a* of the upper basket 12*a* and the identifier 15*b* of the lower basket 12*b* may have a color or a shape different from the door identifier 14.

The basket identifiers 15*a* and 15*b* may be attached to a handle 16 in front of the door 11 as shown in FIG. 4A and attached to the inside front of the door 11 as shown in FIG. 4B but is not limited thereto, and can be provided at various positions that can be identified by the camera 13 at the time of when the baskets are taken out.

Referring again to FIGS. 1 and 2, the circulation pump 51 includes a universal motor composed of a field coil and an armature, a non-commutator DC motor composed of a permanent magnet and an electric magnet (hereinafter, referred to as 'BLDC motor'), and the like.

In this example, the circulation pump 51 using the BLDC motor capable of controlling the rotational speed is taken as an example.

The nozzles 311, 313, 330, and 340 spray washing water at a high pressure to clean the dishes. The nozzles 311, 313, 330 and 340 include the upper nozzle 311 provided at the upper part of the washing tub 30, the intermediate nozzle 313 provided at the center of the washing tub 30, and the lower nozzles 330 and 340 may be provided.

The upper nozzle 311 is provided on the upper side of the upper basket 12*a* and is capable of spraying the washing water downward while being rotated by the water pressure of the washing water to be sprayed. Accordingly, the upper nozzle 311 can spray the washing water directly toward the dishes placed in the upper basket 12*a*. A plurality of spray holes 312 for spraying the washing water are provided at the lower end of the upper nozzle 311.

The intermediate nozzle 313 is provided between the upper basket 12*a* and the lower basket 12*b* and is capable of spraying the washing water in the vertical direction while rotating by the water pressure of the washing water to be sprayed. Accordingly, the intermediate nozzle 313 can spray the washing water directly toward the dishes placed in the upper basket 12*a* and the lower basket 12*b*. That is, a plurality of spray holes 314 for spraying the washing water are provided at the upper and lower ends of the intermediate nozzle 313.

The lower nozzles 330 and 340 may be fixed to one side of the washing tub 30 so as not to move unlike the upper nozzle 311 and the intermediate nozzle 313. The lower nozzles 330 and 340 may be disposed adjacent to the rear wall 32 of the washing tub 30 so as to spray the washing water toward the front of the washing tub 30. Therefore, the washing water sprayed from the lower nozzles 330 and 340 may not directly spray to the dishes.

The washing water sprayed from the lower nozzles 330 and 340 may be reflected to the dish side by the vane 400. The lower nozzles 330 and 340 are disposed below the lower basket 12*b* and the vane 400 reflects the washing water sprayed from the lower nozzles 330 and 340 upward. That is, the washing water sprayed from the lower nozzles 330 and 340 is reflected by the vane 400 toward the dishes placed in the lower basket 12*b*.

The lower nozzles 330 and 340 have a plurality of jet holes 331 and 341 arranged in the left-right direction of the washing tub 30, respectively. The plurality of spray holes 331 and 341 spray the washing water forward.

The vane 400 may be installed to extend in the left-right direction of the washing tub 30 so as to reflect all the washing water sprayed from the plurality of injection holes 331 and 341 provided in the lower nozzles 330 and 340. That is, one longitudinal end of the vane 400 is adjacent to the left side wall 33 of the washing tub 30 and the other longitudinal end of the vane 400 is provided adjacent to the right side wall 34 of the washing tub 30.

The vanes 400 can linearly reciprocate along the spray direction of the washing water sprayed from the lower nozzles 330 and 340. That is, the vane 400 moves between a first position P1 located close to the door 11 and a second position P2 located near the lower nozzles 330 and 340, and changes the spraying direction of the washing water sprayed from the lower nozzles 330 and 340 by linearly reciprocating along the front-rear direction of the washing tub 30.

Here, the second position P2 is a position where the interval between the vane 400 and the lower nozzles 330 and 340 is minimized. The first position P1 is the position of the vane 400 which is detected using the time of movement of the vane 400 from the second position P2 such that maximized location that the distance between the vane 400 and the lower nozzles 330 and 340 is maximized by the vane 400 approaches the door 11.

Therefore, a linear type injection structure including the lower nozzles 330 and 340 and the vane 400 can wash the dishes by spraying the washing water to the entire area of the washing tub 30 without a dead zone.

The vane 400 is linearly reciprocated along the front-rear direction of the washing tub 30 between the first position P1 and a third position P3 between the first position P1 and the second position P2, and it is possible to change the spraying direction of the washing water sprayed from the lower nozzles 330 and 340.

Also, the vane 400 is linearly reciprocated along the front-rear direction of the washing tub 30 between the third position P3 and the second position P2, and it is possible to change the spraying direction of the washing water sprayed from the lower nozzles 330 and 340.

Here, the third position P3 is a position of the vane 400 to be detected using the time when the vane 400 moves from the second position, for example, the third position P3 can be a position between the first position P1 and the second position P2.

Accordingly, the linear type injection structure including the lower nozzles 330 and 340 and the vane 400 sprays the washing water to wash the dishes separately in a front area between the first position P1 and the third position P3, and a rear area between the third position P3 and the second position P2. The washing water can be sprayed and the dishes can be cleaned.

Thus, the dish washing machine 1 can be divided and cleaned independently of the front area and the rear area of the washing tub 30.

The lower nozzles 330 and 340 include the lower left nozzle 330 disposed on the left side of the washing tub 30 and the lower right nozzle 340 disposed on the right side of the washing tub 30.

The upper nozzle 311, the intermediate nozzle 313 and the lower nozzles 330 and 340 can independently spray the washing water, and the lower left nozzle 330 and the lower right nozzle 340 can also independently spray the washing water.

The washing water sprayed from the lower left nozzle 330 is reflected only to the left area of the washing tub 30 by the vane 400 and the washing water sprayed from the lower right nozzle 340 is reflected to the washing tub 30 by the vane 400.

Therefore, the dish washing machine 1 can independently clean the left area and the right area of the washing tub 30 separately.

Meanwhile, in the above-described example, the cleaning is divided into the front side and the rear side, and the left side and the right side of the washing tub 30, but the embodiment of the dish washing machine 1 is not limited thereto.

The camera 13 is provided at the upper end of the main body 10 and can take pictures of the front surface of the main body 10. The camera 13 photographs the door identifier 14 when the door 11 is opened such that the baskets 12*a* and 12*b* are positioned inside the main body 10 and when the basket is taken out, the basket identifiers 15*a* and 15*b* can also be photographed.

Figure 5:
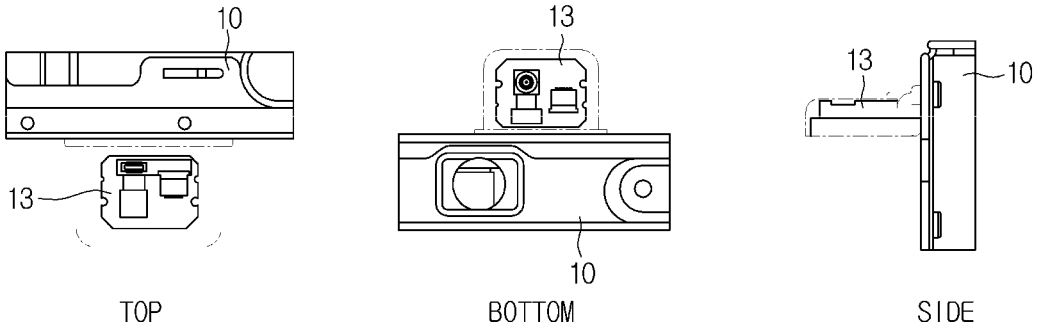
FIG. 5 is an enlarged view of top, bottom, and side surfaces of a camera provided in the dish washing machine in accordance with an embodiment of the disclosure.
Figure 6:
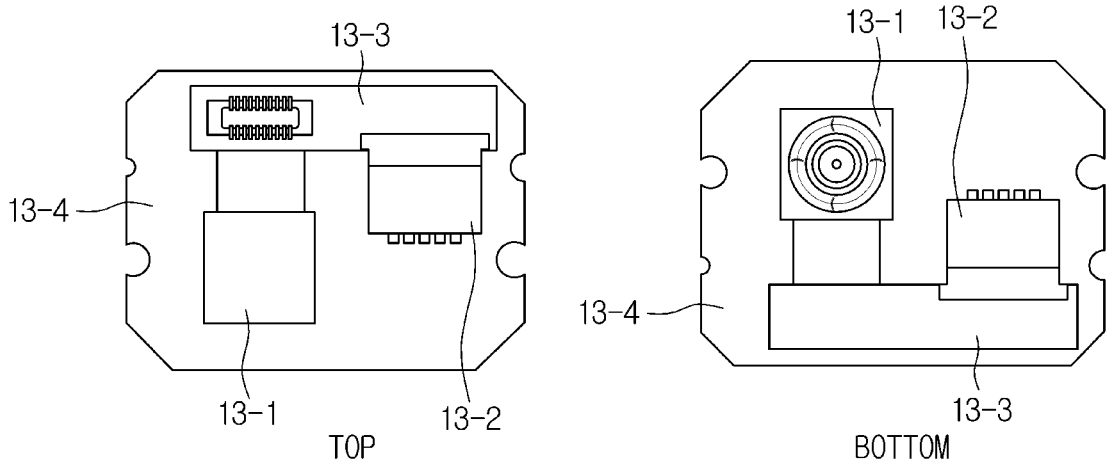
FIG. 6 is an internal view of the camera as viewed from the top and bottom.

FIG. 5 is an enlarged view of top, bottom, and side surfaces of a camera provided in the dish washing machine in accordance with an embodiment of the disclosure, and FIG. 6 is an internal view of the camera as viewed from the top and bottom.

The camera 13 includes an image sensor chip 13-1, a camera controller 13-2 for controlling the image sensor chip 13-1, a substrate 13-3 on which the image sensor chip 13-1 and the camera controller 13-2 are mounted, and a case 13-4 surrounding the image sensor chip 13-1, the camera controller 13-2, and the substrate 13-3.

As shown in FIG. 5, the case 13-4 of the camera 13 is protruded from the upper end of the main body 10, and the image sensor chip 13-1 is mounted on the case 13-4 such that the bottom surface can be photographed at the protruded position. Thus, the image sensor chip 13-1 can photograph the front surface of the main body 10 of the dish washing machine 1.

The image sensor chip 13-1 captures an image under the control of the camera controller 13-2 and the camera controller 13-2 stores the captured image and transmits the image to other electrically connected components. For this, the camera controller 13-2 may include a processor and a memory for executing the stored program.

However, the position and shape of the camera 13 are not limited to those shown in FIGS. 5 and 6, and may be provided at any position where the front surface of the main body 10 can be captured.

Also, the structure of the dish washing machine 1 described above is merely an example, and the number and position of the baskets, the number and position of the nozzles, the structure of the nozzles and the like are not limited to the above-described examples. The structure of the dish washing machine 1 can be implemented differently from the above-described example.

Figure 7:
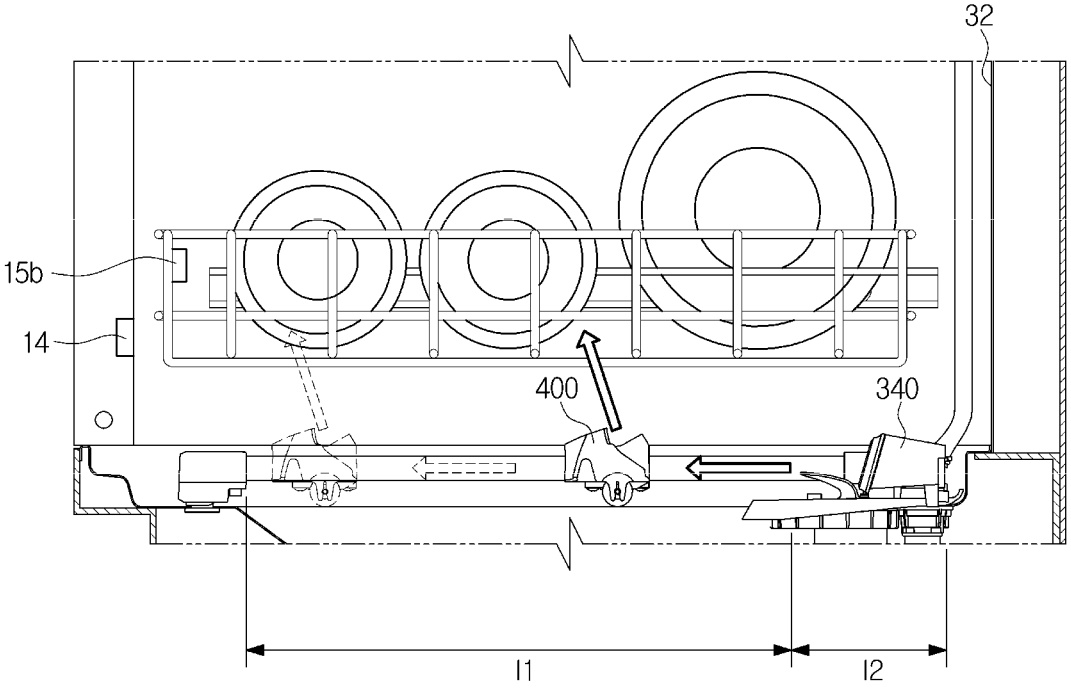
FIG. 7 is a view illustrating an operation of a vane to reflect washing water in a vane moving section of the dish washing machine in accordance with an embodiment of the disclosure.
Figure 8:
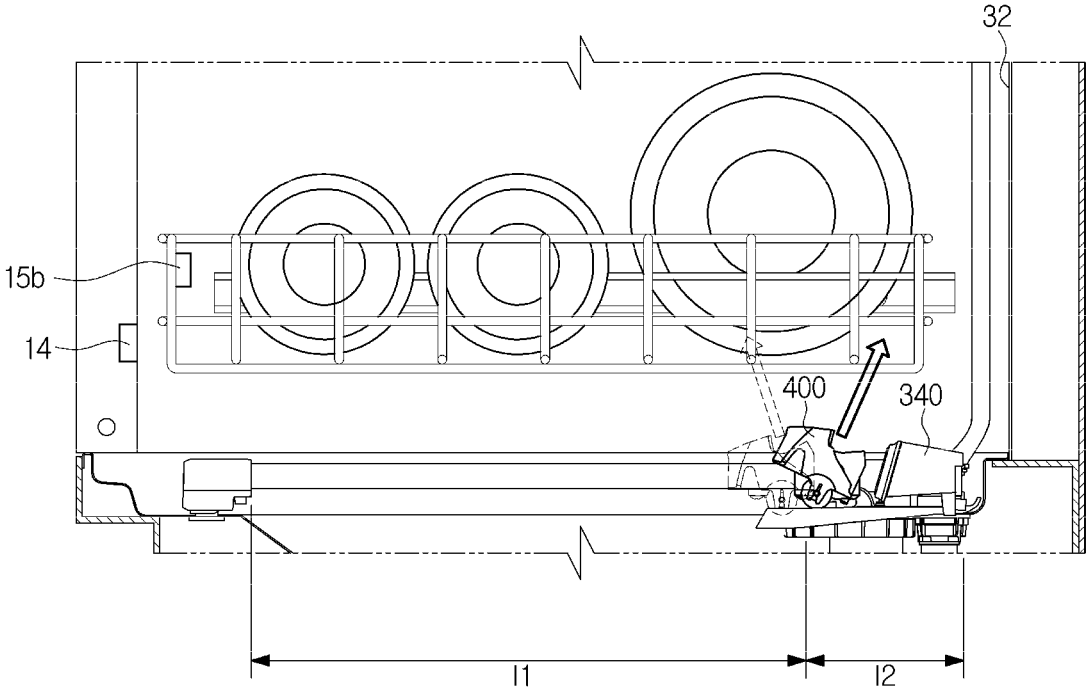
FIG. 8 is a view illustrating an operation of the vane to reflect washing water in a non-vane moving section of the dish washing machine in accordance with an embodiment of the disclosure.

FIG. 7 is a view illustrating an operation of a vane to reflect washing water in a vane moving section of the dish washing machine in accordance with an embodiment of the disclosure, and FIG. 8 is a view illustrating an operation of the vane to reflect washing water in a non-vane moving section of the dish washing machine in accordance with an embodiment of the disclosure.

The vane 400 can reflect the washing water sprayed from the lower nozzles 330 and 340 to a tableware side. The lower nozzles 330 and 340 spray the washing water in a substantially horizontal direction such that the lower nozzles 330 and 340 and the vane 400 are positioned approximately horizontally with respect to each other. Therefore, the vane 400 is not able to move in the area where the lower nozzles 330 and 340 are disposed.

As shown in FIG. 7, the dish washing machine 1 has a vane moving section I1 in which the vane 400 can move and a vane non-moving section I2 in which the vane 400 cannot move.

The vane 400 of the dish washing machine 1 according to one embodiment may be provided to wash the dishes placed in the vane non-moving section I2 rotatable.

As shown in FIG. 8, when the vane 400 rotates toward the vane non-moving section I2 when the vane 400 reaches the vane non-moving section I2 from the vane moving section I1, the washing water can be reflected toward the dishes of the vane non-moving section I2.

Hereinafter, the main components of the dish washing machine 1 will be described in turn with reference to the drawings.

First, a process, flow path structure, bottom nozzle structure, and washing water distribution structure of the dish washing machine 1 will be described with reference to FIG. 9 together with the above-mentioned drawings.

Figure 9:
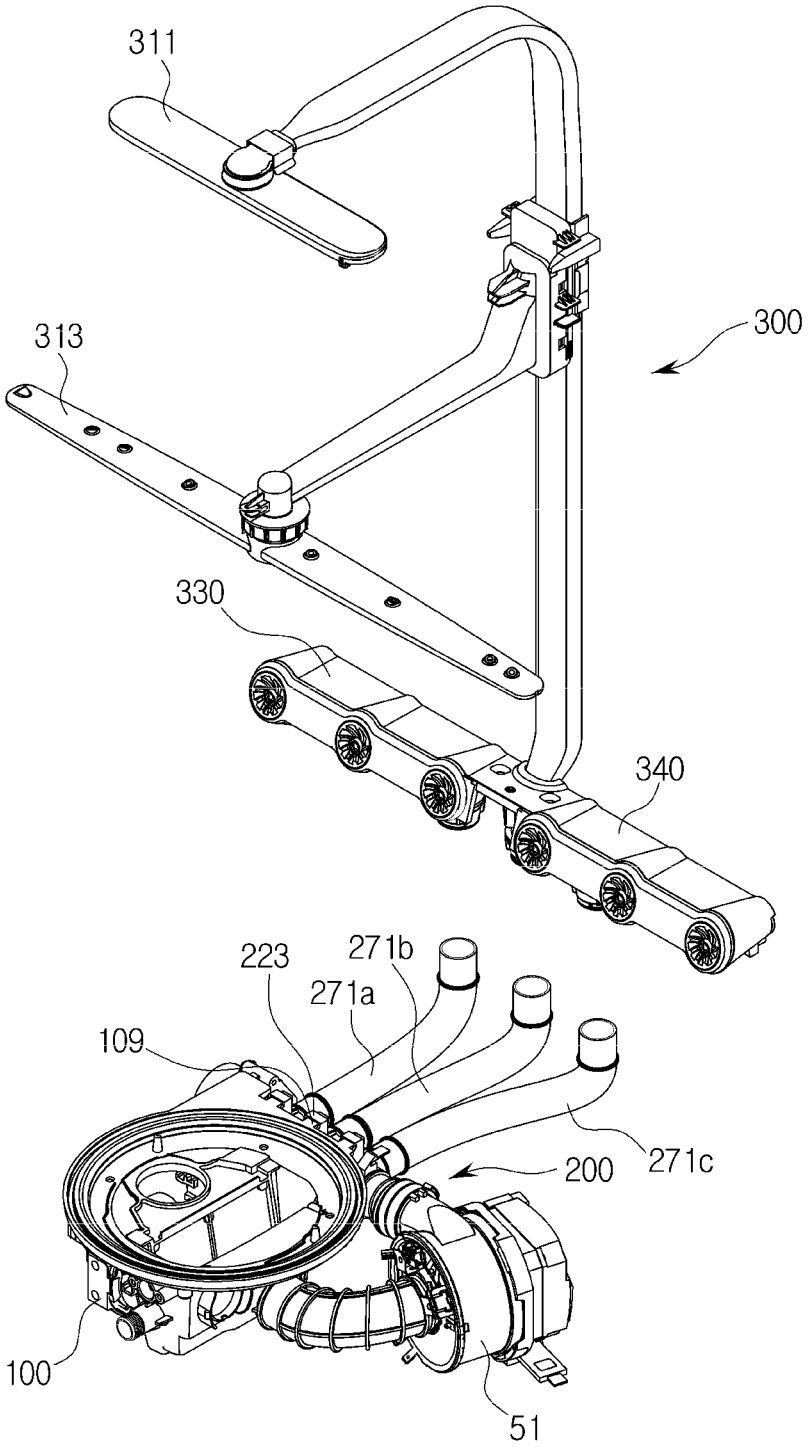
FIG. 9 is a view illustrating a channel structure of the dish washing machine in accordance with an embodiment of the disclosure.

FIG. 9 is a view illustrating a channel structure of the dish washing machine in accordance with an embodiment of the disclosure.

The process performed by the dish washing machine 1 according to one embodiment may include a water supply process, a washing process, a draining process, and a drying process.

When the washing water is supplied into the washing tub 30 through a water supply pipe (not shown) in the water supply process, the washing water supplied to the washing tub 30 is supplied to the washing tub 30 by the gradient of the bottom plate 35 of the washing tub 30, flows into the sump 100 provided at the lower part and is stored in the sump 100.

In the washing process, the circulation pump 51 operates to pump the washing water stored in the sump 100. The washing water pumped by the circulation pump 51 is distributed to the upper nozzle 311, the intermediate nozzle 313, the lower left nozzle 330 and the lower right nozzle 340 through a distribution device 200. The washing water is sprayed at a high pressure from a nozzle assembly 300 by a pumping force of the circulation pump 51 to wash the dishes.

Here, the upper nozzle 311 and the intermediate nozzle 313 can be supplied with the washing water through a second hose 271*b* of the distribution device 200. The lower left nozzle 330 can receive the washing water through a first hose 271*a* of the distribution device 200. The lower right nozzle 340 can be supplied with the washing water through a third hose 271*c* of the distribution device 200.

In this example, the distribution device 200 is configured to have a total of four distribution modes.

In the first mode, the distribution device 200 supplies washing water to the upper nozzle 311 and the intermediate nozzle 313 through the second hose 271*b*.

In the second mode, the distribution device 200 supplies washing water to the lower right nozzle 340 through the third hose 271*c*.

In the third mode, the distribution device 200 supplies washing water to the lower left nozzle 330 and the lower right nozzle 340 through the first hose 271*a* and the third hose 271*c*.

In the fourth mode, the distribution device 200 supplies washing water to the lower left nozzle 330 through the first hose 271*a*.

On the other hand, it is needless to say that the distribution device 200 may be provided to have more various distribution modes than the above-described example.

The washing water sprayed from the nozzles 311, 313, 330, and 340 hits the dishes, removes foreign matter adhering to the dishes, drops with the foreign matter, and can be stored in the sump 100 again. The circulation pump 51 pumps and circulates the washing water stored in the sump 100 again. During the washing process, the circulation pump 51 can be repeatedly operated and stopped. In this process, the foreign matter dropped into the sump 100 together with the washing water are collected by a filter installed in the sump 100 and remain in the sump 100 without being circulated to the nozzles 311, 313, 330 and 340.

In the draining process, the drain pump 52 operates to discharge the foreign matter remaining in the sump 100 and the washing water to the outside of the main body 10 together.

In the drying process, a heater (not shown) installed on the washing tub 30 operates to dry the dishes.

Hereinafter, the operation of the dish washing machine 1 will be described in detail based on the structure of the dish washing machine 1 described above.

Figure 10:
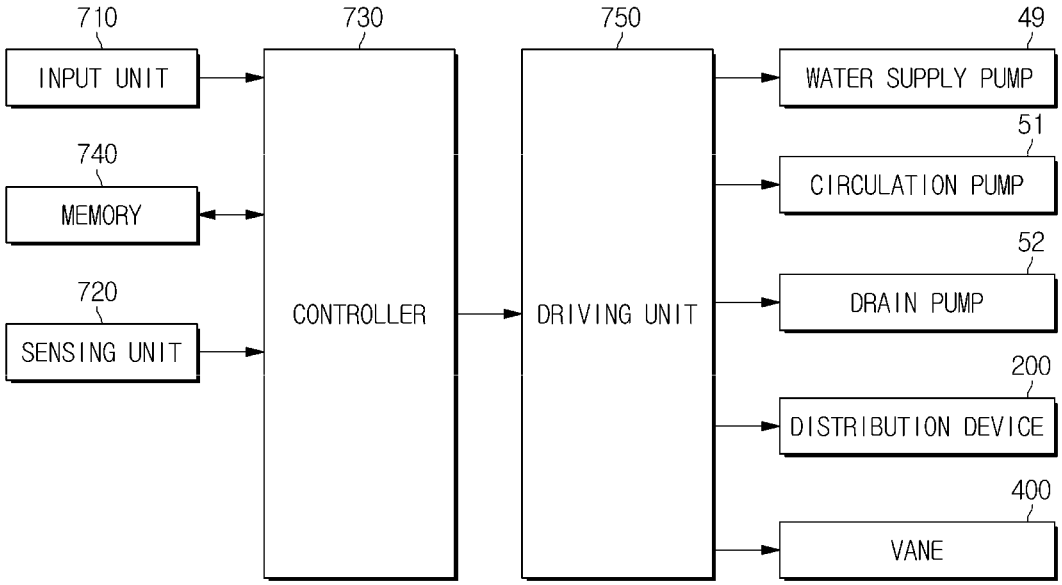
FIG. 10 is a block diagram of the dish washing machine in accordance with an embodiment of the disclosure.

FIG. 10 is a block diagram of the dish washing machine in accordance with an embodiment of the disclosure.

Referring to FIG. 10, the dish washing machine 1 may include an input unit 710, a sensing unit 720, a controller 730, a memory 740, and a driving unit 750.

The input unit 710 can receive a command for performing the water supply process, the washing process, the rinsing process, and the drying process of the dish washing machine 1 by a user's command.

Also, the input unit 710 can receive a command from the user for operation information such as a washing course, washing water temperature, additional rinsing, etc.

The washing course includes a standard course, which includes the water supply process for supplying washing water, the washing process for washing the dishes by spraying the washing water to the dishes after the water supply, a heating step for heating the washing water to a proper temperature for washing and rinsing before the washing water is sprayed to the dishes, and a manual course for arbitrarily selecting and operating each process according to the situation.

The input unit 710 may include a jog shuttle that can input commands by pressing or touching by the user, or may be pushed or turned in the up, down, left, and right directions.

The sensing unit 720 senses the various identifiers 14, 15*a*, and 15*b* attached to the dish washing machine 1 and transmits the sensed identifiers 14, 15*a*, and 15*b* to the controller 730.

The controller 730 can control the overall operation of the dish washing machine 1 such as the water supply process, the washing process, the draining process, and the drying process in accordance with a manipulation input through the input unit 710. That is, the controller 730 may generate a control signal for controlling the water supply valve 49, the circulation pump 51, the drain pump 52, the distribution device 200, etc., in order to perform the respective process.

The controller 730 may perform an operation corresponding to the information received from the sensing unit 720.

When the sensing unit 720 detects the basket identifiers 15*a* and 15*b*, it is possible to determine whether the basket identifiers 15*a* and 15*b* are the identifier 15*a* of the upper basket 12*a* or the identifier 15*b* of the lower basket 12*b* based on the detection result of the sensing unit 720.

For example, if the identifier 15*a* of the upper basket 12*a* and the identifier 15*b* of the lower basket 12*b* have different colors or different patterns, the sensing unit 720 can distinguish the identifier 15*a* of the upper basket 12*a* and the identifier 15*b* of the lower basket 12*b* based on the image captured by the sensing unit 720.

The controller 730 can determine whether the basket 12*a* or 12*b* is in or out of the basket 12 based on the detection result of the sensing unit 720. For example, when the identifier 15*a* of the upper basket 12*a* is detected and the identifier 15*a* of the upper basket 12*a* moves in a direction away from the door 11 in the image captured by the sensing unit 720, the controller 730 can determine that the upper basket 12*a* is taken out. The controller 730 can also measure the distance that the identifier 15*a* of the upper basket 12*a* can measure the distance away from the door 11 and whether the upper basket identifier 15*a* is a predetermined distance away from the door 11, controller 730 can determine that the upper basket 12*a* has been taken out completely.

When the identifier 15*a* of the upper basket 12*a* is detected and the identifier 15*a* of the upper basket 12*a* moves in the direction closer to the door 11 in the image captured by the sensing unit 720, the controller 730 may determine that the upper basket 12*a* is put back in. The controller 730 can also determine whether the lower basket 12*b* is carried in or out as in the case of the upper basket 12*a*.

Also, the controller 730 can determine the position of the dishes placed in the lower basket 12*b* based on the detection result of the sensing unit 720.

Specifically, when the lower basket 12*b* is completely taken out, the controller 730 can determine the position of the basket identifier 15*b* and the position of a portion where the door identifier 14 is hidden based on the image photographed by the sensing unit 720.

The controller 730 can determine the position of the basket identifier 15*b* and the position of the portion where the door identifier 14 is overlapped based on the image photographed by the sensing unit 720.

The controller 730 can determine the area in which the dishes in the lower basket 12*b* are placed based on the position of the basket identifier 15*b* and the position of the portion where the door identifier 14 is overlapped. A detailed method of determining the area in which the dishes are accommodated will be described later with reference to FIGS. 11 to 16.

The controller controls the driving unit 750 such that the washing water is supplied to the determined dish storage area when the lower basket 12*b* is fully put back in.

The controller 730 may include a processor for executing a program for performing the operation of the dish washing machine 1. The processor may be included singly, and a plurality of processors may be included depending on the operation of the dish washing machine 1.

The memory 740 stores a program for performing the operation of the dish washing machine 1, control data for controlling the operation of the dish washing machine 1, reference data used during operation control of the dish washing machine 1, setting data such as the setting data input by the input unit 710 such that the dish washing machine 1 performs a predetermined operation, and the like, use information including the number of times of execution, model information of the dish washing machine 1, and the cause of malfunction or malfunction position at the time of malfunction of the dish washing machine 1.

The memory 740 may include a non-volatile memory (not shown) such as a magnetic disk or a semiconductor disk for permanently storing data, and a volatile memory (not shown) such as D-RAM or S-RAM for temporarily storing data generated in the process of controlling the operation of the dish washing machine 1.

The water supply valve 49 controls the supply of water (washing water) supplied into the washing tub 30 through the water supply pipe (not shown) in the water supply process. For example, when the water supply valve 49 is opened, the washing water is supplied into the washing tub 30 through the water supply pipe, and when the water supply valve 49 is closed, the supply of the washing water is stopped.

The description of the circulation pump 51, the drain pump 52, the distribution device 200, and the vane 400 is as described above.

The driving unit 750 controls the water supply valve 49, the circulation pump 51, the drain pump 52, the distribution device 200, the vanes 400 and the like.

The driving unit 750 includes at least one motor for generating power to be supplied to the water supply valve 49, the circulation pump 51, the drain pump 52, the distribution device 200, and the vane 400, and may further include a structure such as a gear for transmitting the generated power as needed.

A plurality of motors corresponding to the water supply valve 49, the circulation pump 51, the drain pump 52, the distribution device 200 and the vane 400 may be provided, and the plurality of motors may be disposed at a position capable of providing power to the water supply valve 49, the circulation pump 51, the drain pump 52, the distribution device 200, and the vane 400.

For example, the motor that supplies power to the vane 400 may be disposed below a bottom plate cover 600, and the driving device 420 of the vane 400 may be included in the driving unit 750.

At least one component may be added or deleted corresponding to the performance of the components of the dish washing machine 1 shown in FIG. 10. It will be readily understood by those skilled in the art that the mutual position of the components can be changed corresponding to the performance or structure of the system.

On the other hand, FIG. 10 may be software and/or hardware components such as Field Programmable Gate Arrays (FPGAs) and Application Specific Integrated Circuits (ASICs).

Hereinafter, with reference to FIGS. 11 to 16, a method of determining the area in which the dishes are placed by the controller 730 will be described.

Figure 11:
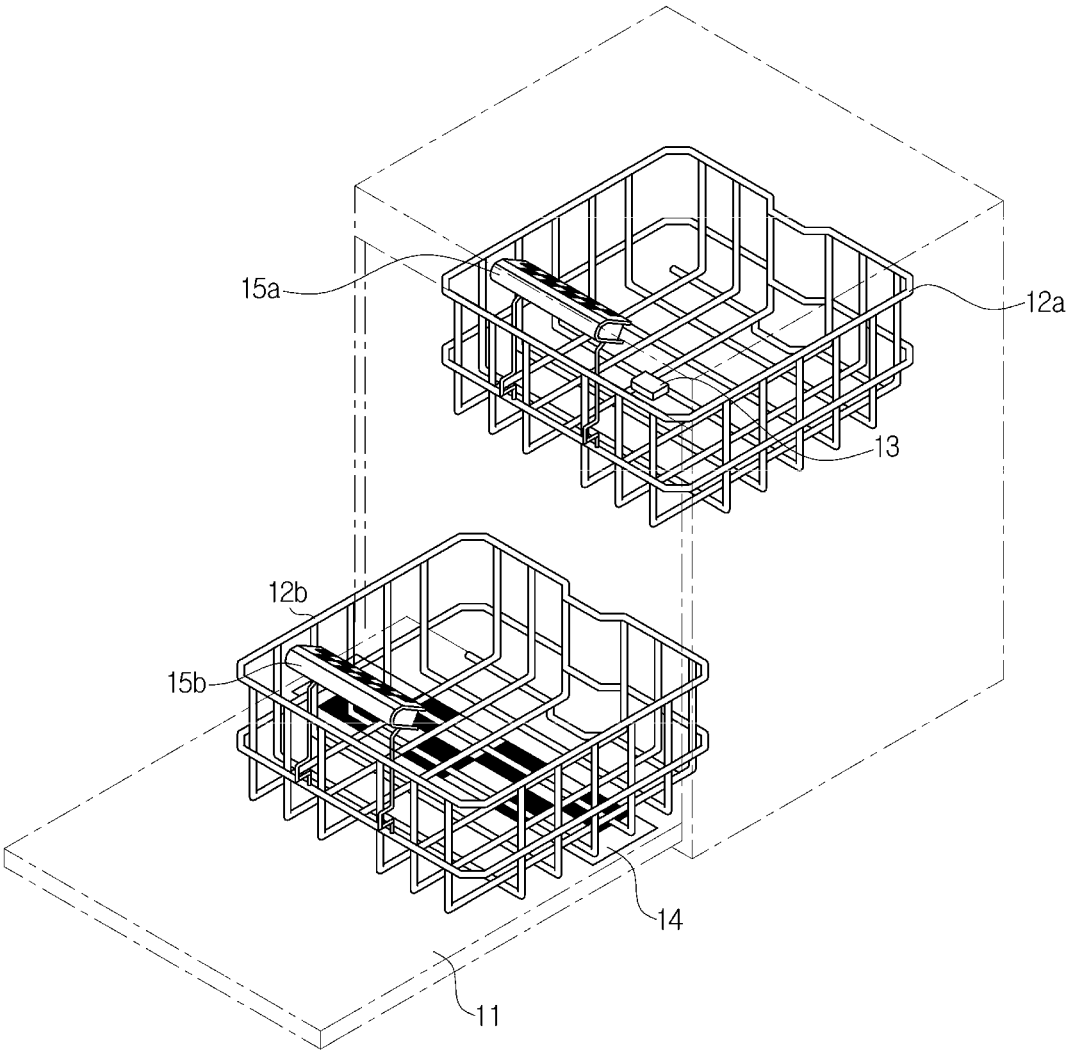
FIG. 11 is a perspective view of the dish washing machine provided with a door identifier and a basket identifier.
Figure 12:
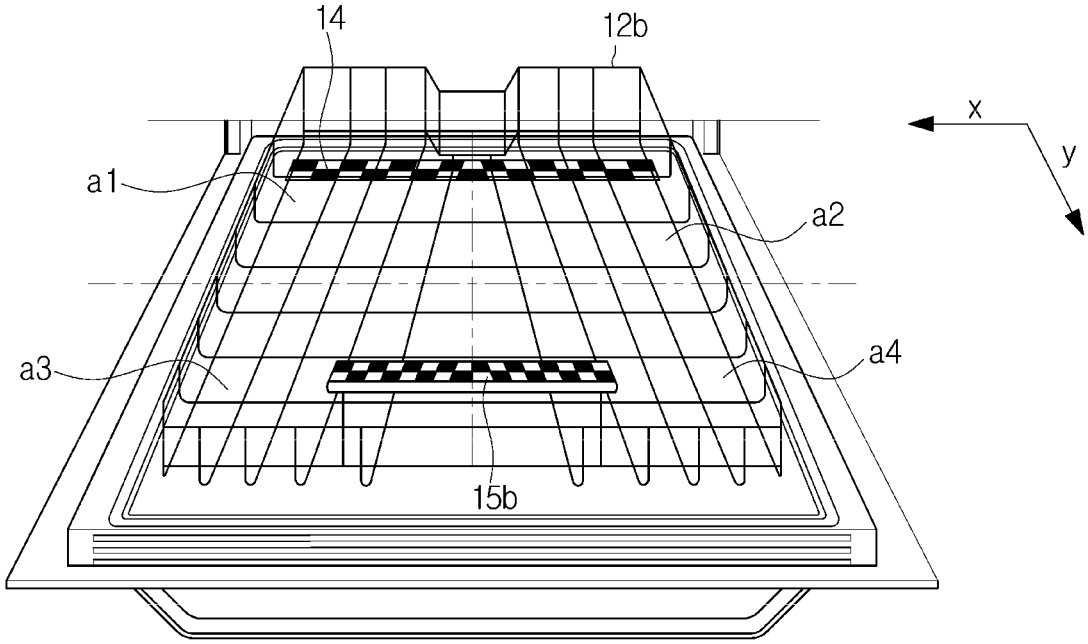
FIG. 12 is a sectional view of the lower basket of FIG. 9 viewed from above.

FIG. 11 is a perspective view of the dish washing machine provided with a door identifier and a basket identifier, and FIG. 12 is a sectional view of the lower basket in FIG. 9 viewed from above.

Referring to FIG. 11, the camera 13 provided outside the main body 10 detects the door identifier 14 attached to the rear surface of the door 11 when the door 11 is opened by capturing the front surface of the main body 10 and the basket identifiers 15*a* and 15*b* attached to the baskets 12*a* and 12*b* can be detected when the baskets 12*a* and 12*b* are carried out. In this case, the upper basket identifier 15*a* and the lower basket identifier 15*b* include different colors or patterns, such that the controller 730 controls the upper basket identifier 15*a* and the lower basket identifier 15*b* based on the image captured by the camera 13, and the upper basket 12*a* and the lower basket 12*b* can be distinguished from each other, therefore, whether or not the upper basket 12*a* and the lower basket 12*b* are carried out or carried in can be determined.

Hereinafter, with reference to FIG. 12, the controller 730 divides the dish storage area into first to fourth areas a1, a2, a3 and a4 of the lower basket 12*b*, and a case where dishes are housed in at least one of the areas a1, a2, a3 and a4 of the lower basket 12*b* in a state in which the basket 12*b* is taken out will be described as an example.

First, the controller 730 determines the position, that is, the coordinates, of the portion to which the door identifier 14 is overlapped. The coordinates of the portion where the door identifier 14 is overlapped may be an x-coordinate indicating the shortest distance and the longest distance from the right end of the door 11 to the portion where the door identifier 14 is overlapped, the door identifier 14 may determine that the width of the portion where the door identifier 14 is overlapped by using the difference between the shortest distance and the longest distance to the portion where the door identifier 14 is overlapped.

In addition, the controller 730 determines the position, i.e., the coordinates, of the lower basket identifier 15*b*. The coordinates of the lower basket identifier 15*b* may be a y-coordinate indicating the distance from the rear end of the door 11 (i.e., from the front opening of the washing tub 30) to the lower basket identifier 15*b*.

Figure 13:
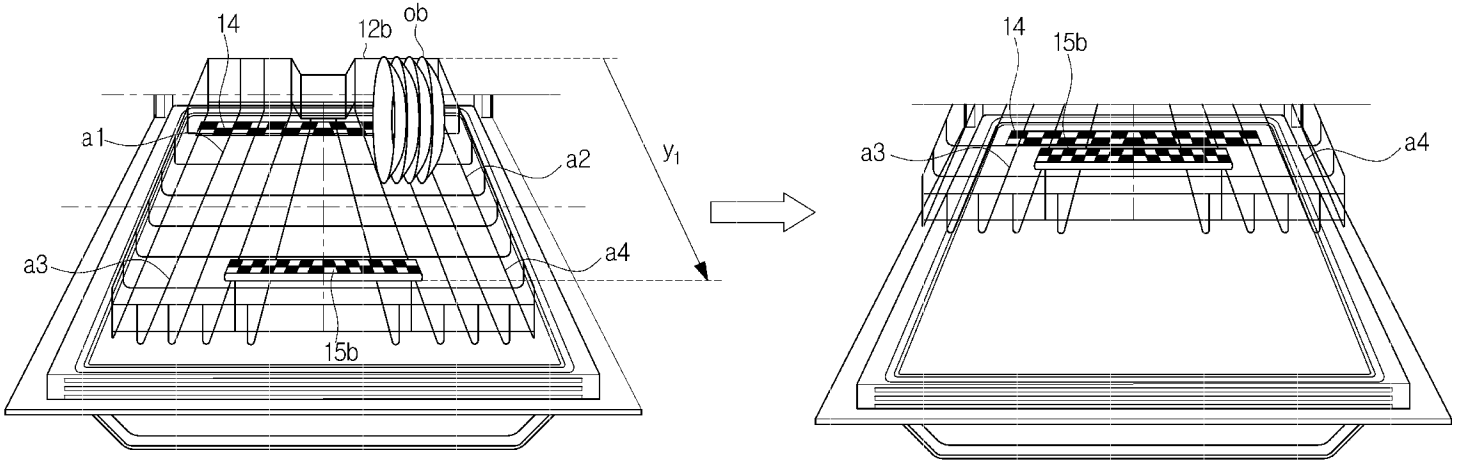
FIG. 13 is a cross-sectional view of a completely carried out lower basket and a partially carried out lower basket when dishes are placed in a second area of the lower basket.

FIG. 13 is a cross-sectional view of a completely carried out lower basket and a partially carried lower basket when dishes are placed in a second area of the lower basket.

Referring to the left side of FIG. 13, when the lower basket 12*b* is completely taken out based on the image captured by the camera 13, an x-coordinate x2 of the start point of the portion of the door identifier 14 covered by a dish ob and an x-coordinate x1 of the end point and a y-coordinate y1 of the lower basket identifier 15*b* can be detected.

Here, y1 and y2 represent the degree to which the lower basket 12*b* is taken out, y1 may be the y-coordinate of the lower basket identifier 15*b* corresponding to the first area a1 and the second area a2, y2 may be the y-coordinate of the lower basket identifier 15*b* corresponding to the third area a3 and the fourth area a4. Accordingly, when the coordinate of the lower basket identifier 15*b* has a value of y1, the controller 730 can determine that the dishes are located in at least one of the first area a1 and the second area a2 and the coordinate of the lower basket identifier 15*b* has a value of y2, it can be determined that the dishes are located in at least one of the third area a3 and the fourth area a4.

Accordingly, the controller 730 determines whether or not the portion of the door identifier 14 covered by the dish ob is included in the first area a1 and the second area a2 based on the y-coordinate y1 of the lower basket identifier 15*b*, and since the x-coordinate starting point (x2) and the ending point (x1) of the portion covered by the dish ob are included in the second area a2, the controller 730 determines that the portion of the door identifier 14 finally covered by the dish ob is included in the second area a2.

However, when the x-coordinate x1, which is the end point of the portion of the door identifier 14 covered by the dish ob, is larger than the x-coordinate of a central vertical line L1 of the lower basket 12*b*, the controller 730 can determine that the portion of the door identifier 14 covered by the dish ob is also included in the first area a1.

As shown on the right side of FIG. 13, when the lower basket 12*b* is about half put back in, since the dish ob does not cover the door identifier 14, the controller 730 detects the y-coordinate y2 of the lower basket identifier 15*b* based on the image taken by the camera 13, and it is determined that the portion of the door identifier 14 covered by the dish ob is not included in the third area a3 and the fourth area a4 based on the y-coordinate y2 of the lower basket identifier 15*b*.

On the other hand, unlike the right side of FIG. 13, when the dish ob covers the door identifier 14 in a state where the lower basket 12*b* is about halfway put back in, the controller 730 detects the x-coordinate of the portion of the door identifier 14 and the y-coordinate y2 of the lower basket identifier 15*b* based on the image captured by the camera 13, and determines that the portion of the door identifier 14 covered by the dish ob is in at least one of the third area a3 and the fourth area a4 based on the x-coordinate of the portion of the door identifier 14 and the y-coordinate y2 of the lower basket identifier 15*b*. Whether the portion of the door identifier 14 covered by the dish ob is included in the third area a3 or the fourth area a4 can be determined based on the x-coordinates of the starting point and the ending point of the portion of the door identifier 14 covered by the dish ob.

Figure 14:
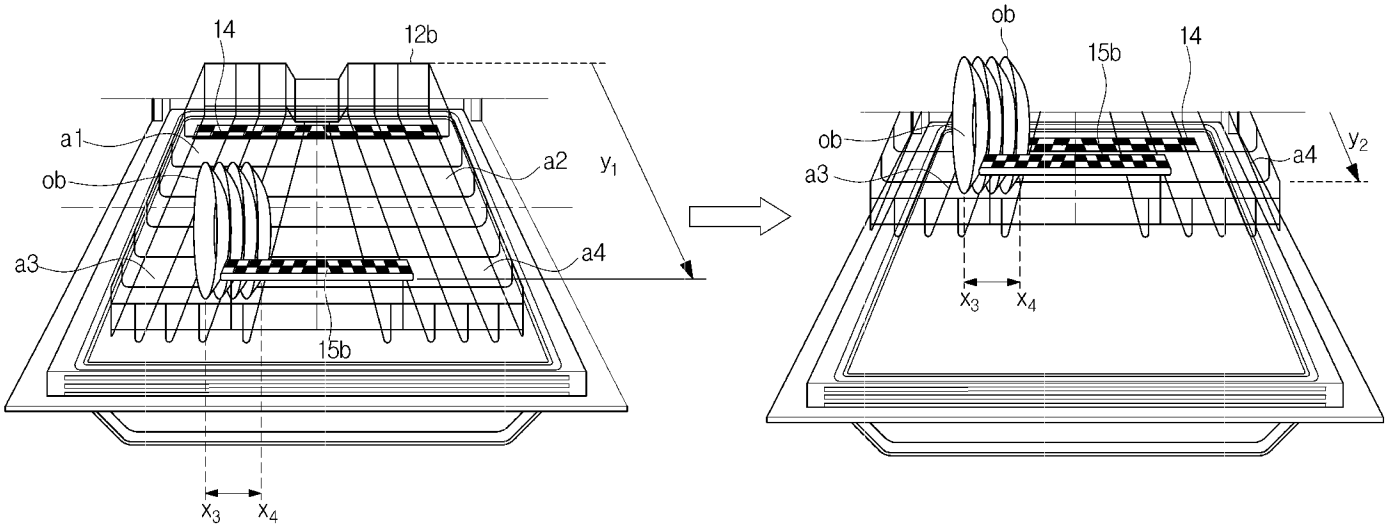
FIG. 14 is a cross-sectional view of the completely carried out lower basket and the partially carried out lower basket when dishes are placed in a third area of the lower basket.

FIG. 14 is a cross-sectional view of the completely carried out lower basket and the partially carried out lower basket when dishes are placed in a third area of the lower basket.

As shown on the right side of FIG. 14, when the lower basket 12*b* is completely taken out, the controller 730 detects the y-coordinate y1 of the lower basket identifier 15*b* based on the image taken by the camera 13, and the controller 730 can detect that the portion of the door identifier 14 covered by the dish ob is not included, therefore, the controller 730 determines that the dishes are not placed in the first area a1 and the second area a2, and it is determined that the portion of the door identifier 14 covered by the dish ob is not included in the third area a3 and the fourth area a4 based on the y-coordinate y2 of the lower basket identifier 15*b*.

Also, as shown on the right side of FIG. 13, since the dish ob covers the door identifier 14 in a state where the lower basket 12*b* is about halfway put back in, the controller 730 detects x-coordinates x3 and x4 of the portion of the door identifier 14 and the y-coordinate y2 of the lower basket identifier 15*b* based on the image captured by the camera 13, and determines that the portion of the door identifier 14 covered by the dish ob is in at least one of the third area a3 and the fourth area a4 based on the y-coordinate y2 of the lower basket identifier 15*b*, and since the x-coordinates of the starting point x3 and the ending point x4 of the portion covered by the dish ob are included in the third area a3 in respective order, the controller 730 finally determines that the portion of the door identifier 14, which is covered by the dish ob, is in the third area a3.

However, unlike the right side of FIG. 14, when the x-coordinate x4 of the starting point of the portion of the door identifier 14 covered by the dish ob has a value smaller than the x-coordinate of the central vertical line L1 of the lower basket 12*b*, the controller 730 determines that the portion of the door identifier 14 covered by the dish ob is included in the fourth area a4.

When the dish ob covers the door identifier 14 in a state where the lower basket 12*b* is about halfway put back in, the controller 730 detects the x-coordinate of the portion of the door identifier 14 and the y-coordinate y2 of the lower basket identifier 15*b* based on the image captured by the camera 13, and determines that the portion of the door identifier 14 covered by the dish ob is in at least one of the third area a3 and the fourth area a4 based on the x-coordinate of the portion of the door identifier 14 and the y-coordinate y2 of the lower basket identifier 15*b*. Whether the portion of the door identifier 14 covered by the dish ob is included in the third area a3 or the fourth area a4 can be determined based on the x-coordinates of the starting point and the ending point of the portion of the door identifier 14 covered by the dish ob.

Figure 15:
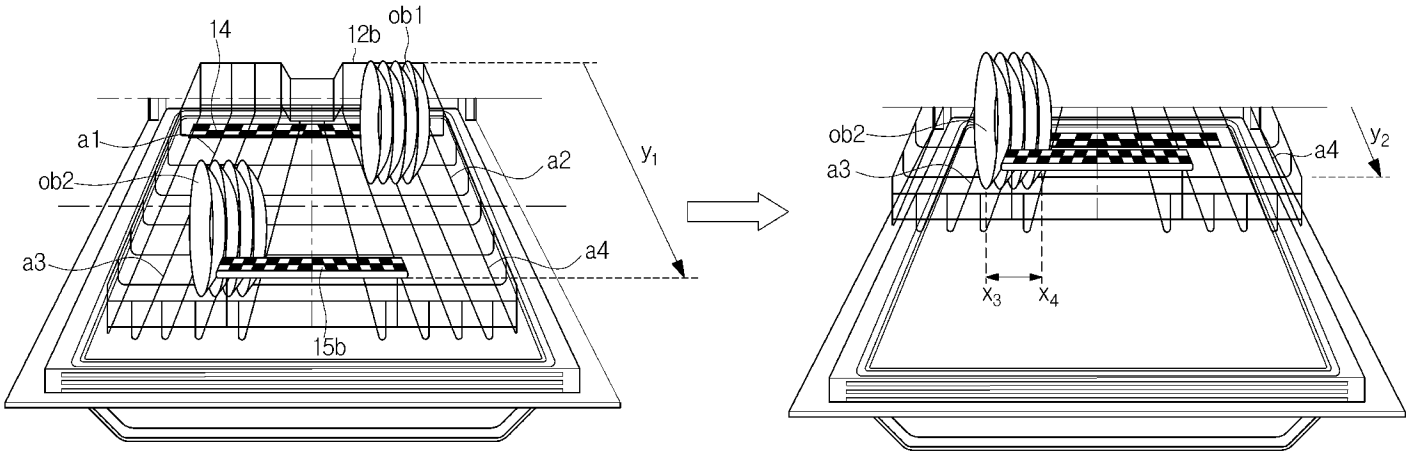
FIG. 15 is a cross-sectional view of the completely carried out lower basket and the partially carried out lower basket when dishes are placed in a plurality of regions of the lower basket, for example, the second area and the third region.

FIG. 15 is a cross-sectional view of the completely carried out lower basket and the partially carried out lower basket when dishes are placed in a plurality of areas of the lower basket, for example, the second area and the third area.

Referring to the left side of FIG. 15, in a state in which the lower basket 12*b* is completely taken out, the controller 730 detects the starting point of the portion of the door identifier 14, which is covered by a dish ob1. The x-coordinate x2 of the lower basket identifier 15*b* and the x-coordinate x1 of the ending point can be detected and the y-coordinate y1 of the lower basket identifier 15*b* can also be detected. The controller 730 can also determine that the portion of the door identifier 14 covered by the dish ob is included in the second area a2 based on the x-coordinate x1 and x2 of the portion of the door identifier 14 and the y-coordinate y1 of the lower basket identifier 15*b*.

When the lower basket 12*b* is about halfway put back in, another dish ob2 covers the door identifier 14, such that the controller 730 detects the x-coordinate x4 of the starting point of the portion of the door identifier 14 and the x-coordinate x3 of the ending point and the y-coordinate y2 of the lower basket identifier 15*b* based on the image captured by the camera 13 and the x-coordinate x3 and x4 of the portion of the door identifier 14 covered by the other dish ob2, and based on the y-coordinate y2 of the lower basket identifier 15*b*, the controller 730 can determine that the door identifier 14 is included in the third area a3.

Therefore, the controller 730 can determine that the dishes are finally placed in the second area a2 and the third area a3.

Figure 16:
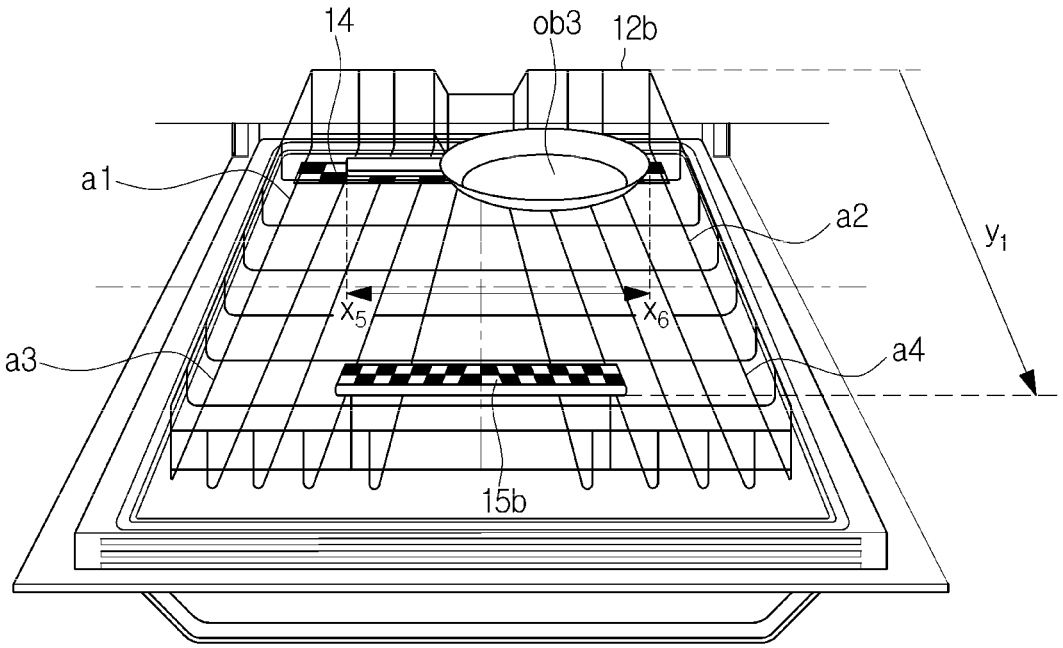
FIG. 16 is a cross-sectional view of the completely carried out lower basket and the partially carried out lower basket when viewed in the plurality of areas of the lower basket, for example, a first area and the second area.

FIG. 16 is a cross-sectional view of the completely carried out lower basket and the partially carried lower basket when viewed in the plurality of areas of the lower basket, for example, a first area and the second area.

Referring to the left side of FIG. 16, when the lower basket 12*b* is completely carried out, the controller 730 can detect the starting point of an x-coordinate x6 and the ending point of an x-coordinate x5 of the portion of the door identifier 14 covered by a dish ob3, and the y-coordinate y1 of the identifier 15*b* of the lower basket based on the image captured by the camera 13. The controller 730 also determines that when the portion of the door identifier 14 covered by the dish ob3 is in at least one of the first area a1 and the second area a2 based on the y-coordinate y1 of the lower basket identifier 15*b*, and the starting point of the x-coordinate x6 of the portion of the door identifier 14 covered by the dish ob is included in the second area a2 and the x-coordinate x5 is included in the first area a1, the controller 730 finally determines that the dish ob3 may be included in the first area a1 and the second area a2.

Also, as shown on the right of FIG. 16, since the dish ob does not cover the door identifier 14 when the lower basket 12*b* is carried in halfway, the controller 730 detects the y-coordinate y2 of the lower basket identifier 15*b* based on the image captured by the camera 13 and detects the y-coordinate y2 of the lower basket identifier 15*b* based on the y-coordinate y2 of the lower basket identifier 15*b*, and determines that the dish ob cannot be included in the third area a3 and the fourth area a4.

Therefore, the controller 730 can determine that the dishes are finally placed in the first area a1 and the second area a2.

Although the above embodiment has been described in which the area of the lower basket 12*b* is divided into the four areas a1, a2, a3 and a4, the area of the lower basket 12*b* may be divided into a plurality of different areas.

Although the above embodiment has described the case where the dish covers the "one" portion of the door identifier 14, it is also possible that the dish covers a "plurality" of the portions of the door identifier 14, and at this time, the controller 730 may determine the dish storage area using the x-coordinate and the y-coordinate of each part.

In this way, if it is determined that the area of the lower basket 12*b* is to be washed and the lower basket 12*b* is completely carried into the washing tub 30, it is possible to control the driving unit 750 such that the washing water is supplied to the area. At this time, the driving unit 750 can drive the dispensing device 200 such that the washing water is supplied to at least one of the lower left nozzle 330 and the lower right nozzle 340 corresponding to the dish storing area in accordance with the control signal of the controller 730, and at least one corresponding to the dish storage area between the first position P1 and the third position P3 described in relation to FIG. 2 and between the third position P3 and the second position P2, drives the vane 400 to perform a linear reciprocating movement along the front-rear direction of the washing tube 30.

Figure 17A:
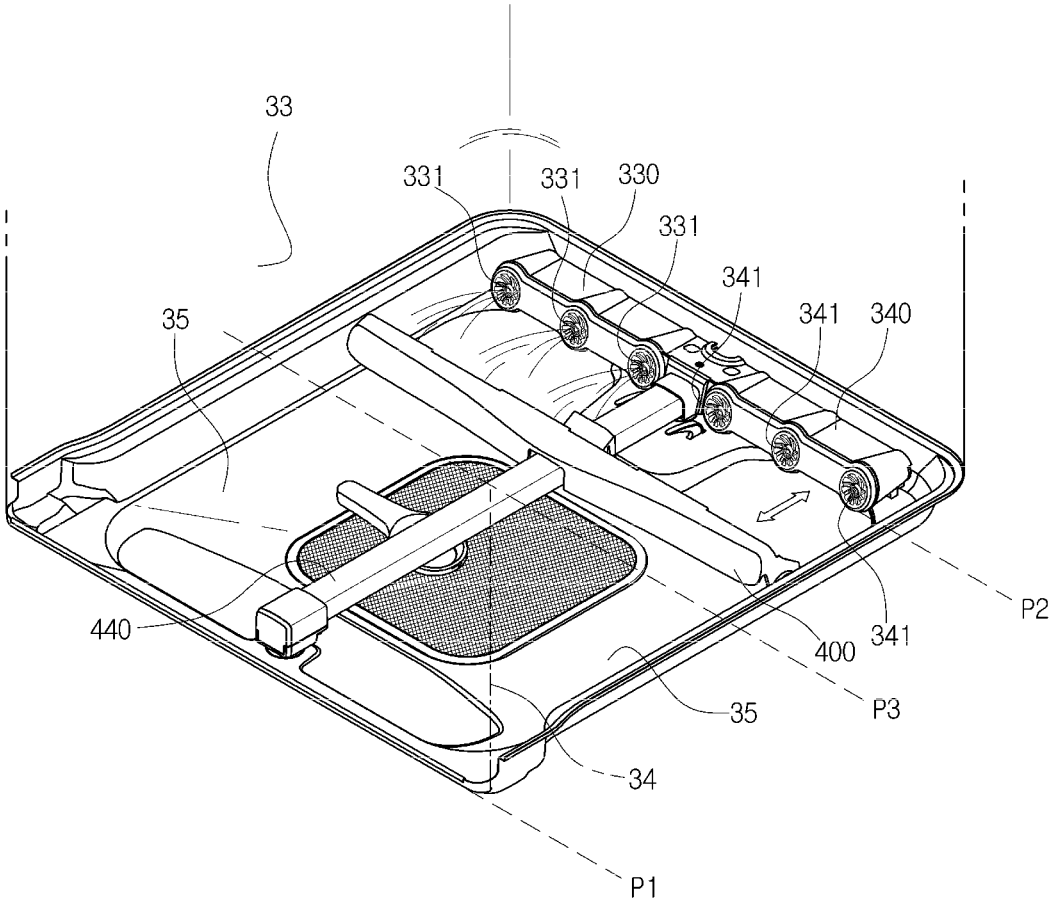
FIG. 17A is a view for explaining a driving process of a driving unit when dishes are placed in the first area.

Hereinafter, with reference to FIGS. 17A and 17B, a method of performing washing by each dish storage area will be described. FIG. 17A is a view for explaining a driving process of a driving unit when dishes are placed in the first area, and FIG. 17B is a view for explaining the driving process of the driving unit when dishes are placed in a fourth area.

As shown in FIG. 17A, when it is determined that the dishes are stored in the first area a1, the controller 730 performs a linear reciprocating movement along a rail 440 in the forward and backward direction between the third position P3 and the second position P2 adjacent to the lower nozzles 330 and 340, and drives the driving unit 750 to supply the washing water to the lower left nozzle 330. Accordingly, the washing water sprayed from the lower left nozzle 330 can be reflected to the first area a1 by the vane 400 reciprocating from the rear side of the washing tub 30.

Figure 17B:
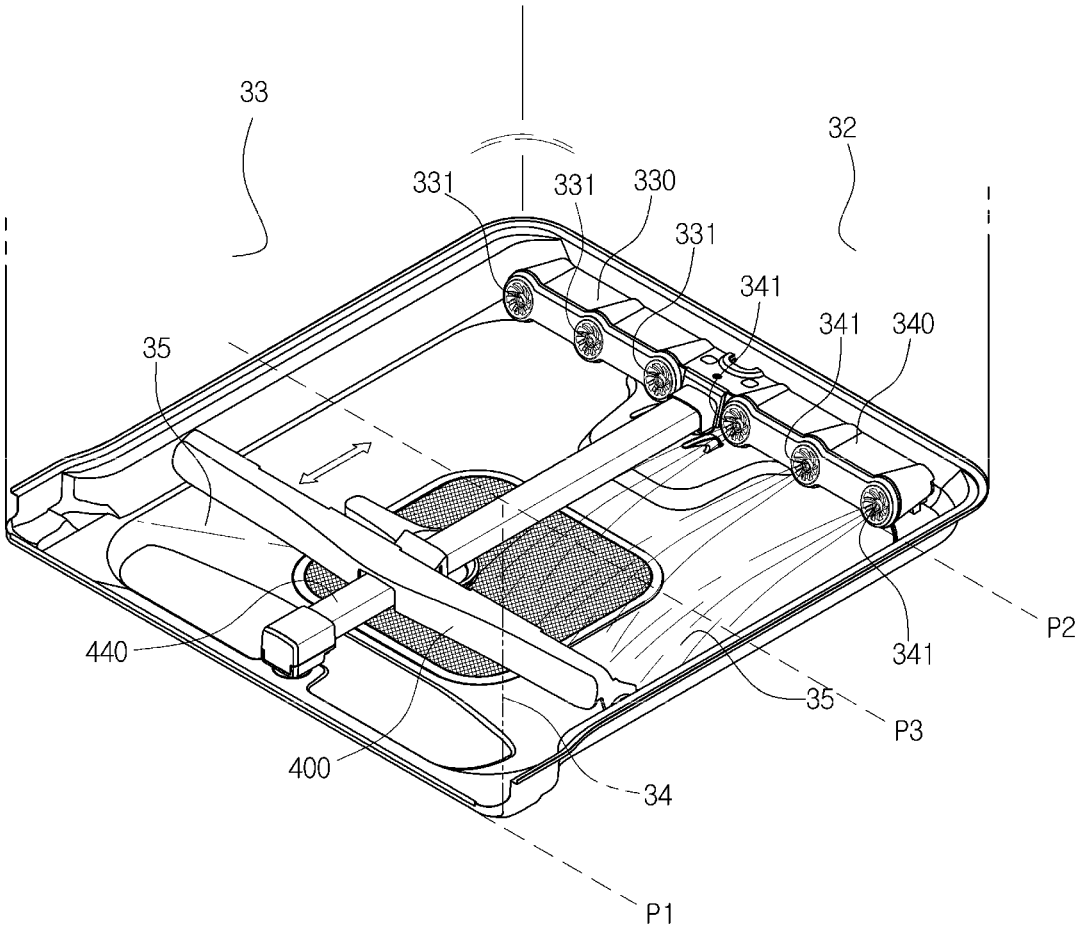
FIG. 17B is a view for explaining the driving process of the driving unit when dishes are placed in a fourth area.

As shown in FIG. 17B, when it is determined that the dishes are stored in the fourth area a4, the controller 730 performs a linear reciprocating movement along the rail 440 in the forward and backward direction between the first position P1 and the third position P3 adjacent to the door 11, and drives the driving unit 750 to supply the washing water to the lower right nozzle 340. Accordingly, the washing water sprayed from the lower right nozzle 340 can be reflected to the fourth area a4 by the vane 400 reciprocating in front side of the washing tub 30.

Although not shown, when it is determined that the dishes are stored in the second area a2, the controller 730 performs a linear reciprocating movement along the rail 440 in the forward and backward direction between the third position P3 and the second position P2 adjacent to the lower nozzles 330 and 340, and drives the driving unit 750 to supply the washing water to the lower right nozzle 340. Accordingly, the washing water sprayed from the lower right nozzle 340 can be reflected to the second area a2 by the vane 400 reciprocating of the rear side of the washing tub 30.

Also, when it is determined that the dishes are stored in the third area a3, the controller 730 performs a linear reciprocating movement along the rail 440 in the forward and backward direction between the first position P1 and the third position P3, and drives the driving unit 750 to supply the washing water to the lower left nozzle 330. Accordingly, the washing water sprayed from the lower left nozzle 330 can be reflected to the third area a3 by the vane 400 reciprocating from the front side of the washing tub 30.

When it is determined that the dishes are stored in the plurality of areas a1, a2, a3, and a4, the controller 730 sequentially selects the vane 400 at positions corresponding to the plurality of areas a1, a2, a3, and a4, performs the linear reciprocating movement and controls the driving unit 750 to supply the washing water to the lower nozzles 330 and 340 corresponding to the plurality of areas a1, a2, a3 and a4, respectively.

Hereinafter, with reference to FIG. 18, a process of the controller 730 controlling the driving unit 750 according to the dish storage area of the lower basket 12*b* will be described. The descriptions of the first to third positions P1 to P3 described below are the same as the first to third positions P1 to P3 described above with reference to FIG. 2.

FIG. 18 is a schematic diagram illustrating an algorithm for driving the vane and a dispensing device when dishes are placed in each dish storage area of the lower basket.

First, as a first case (Case 1), a case where dishes are housed in one of the plurality of dish storage areas a1, a2, a3, and a4 will be described.

When the dishes are housed in the first area a1 located on the left and rear sides of the lower basket 12*b* among the plurality of dish storage areas a1, a2, a3 and a4 (Case 1-1), the controller 730 controls the driving unit 750 to perform a linear reciprocating movement between the second position P2 and the third position P3 (i.e., the rear side of the washing tub 30) to reflect the washing water sprayed from the lower left nozzle 330.

Also, when the dishes are placed in the third area a3 located on the left and front sides of the lower basket 12*b* among the plurality of dish storage areas a1, a2, a3 and a4 (Case 1-2), the controller 730 controls the driving unit 750 to perform a linear reciprocating movement between the first position P1 and the third position P3 (i.e., the rear side of the washing tub 30) to reflect the washing water sprayed from the lower left nozzle 330.

Also, when the dishes are housed in the second area a2 located on the right and rear sides of the lower basket 12*b* among the plurality of dish storage areas a1, a2, a3 and a4 (Case 1-3), the controller 730 controls the driving unit 750 to perform a linear reciprocating movement between the second position P2 and the third position P3 (i.e., the rear side of the washing tub 30) to reflect the washing water sprayed from the lower right nozzle 340.

Also, when the dishes are housed in the fourth area a4 located on the right and rear sides of the lower basket 12*b* among the plurality of dish storage areas a1, a2, a3 and a4 (Case 1-4), the controller 730 controls the driving unit 750 to perform a linear reciprocating movement between the first position P1 and the third position P3 (i.e., the rear side of the washing tub 30) to reflect the washing water sprayed from the lower right nozzle 340.

Next, in a second case (Case 2), a case where dishes are housed in the left areas a1 and a3 or the right areas a2 and a4 among the plurality of dish storage areas a1, a2, a3, and a4 will be described.

When the dishes are housed in the left areas a1 and a3 of the plurality of dish storage areas a1, a2, a3 and a4 (Case 2-1), the controller 730 drives the driving unit 750 to control the lower left nozzle 330 to spray the washing water and the vane 400 to perform a linear reciprocating movement between the first position P1 and the second position P2 (i.e., the front side and the rear side of the washing tub 30) to reflect the washing water.

When the dishes are housed in the right areas a2 and a4 of the plurality of dish storage areas a1, a2, a3 and a4 (Case 2-2), the controller 730 drives the driving unit 750 to control the lower right nozzle 340 to spray the washing water and the vane 400 to perform a linear reciprocating movement between the first position P1 and the second position P2 (i.e., the front side and the rear side of the washing tub 30) to reflect the washing water.

Next, in a third case (Case 3), a case where dishes are housed in the front areas a3 and a4 or the rear areas a1 and a2 among the plurality of dish storage areas a1, a2, a3, and a4 will be described.

When the dishes are housed in the rear areas a1 and a2 of the plurality of dish storage areas a1, a2, a3 and a4 (Case 3-1), the controller 730 drives the driving unit 750 to control the lower left nozzle 330 and the lower right nozzle 340 to spray the washing water and the vane 400 to perform a linear reciprocating movement between the second position P2 and the third position P3 (i.e., the rear side of the washing tub 30) to reflect the washing water.

When the dishes are housed in the front areas a3 and a4 of the plurality of dish storage areas a1, a2, a3 and a4 (Case 3-2), the controller 730 drives the driving unit 750 to control the lower left nozzle 330 and the lower right nozzle 340 to spray the washing water and the vane 400 to perform a linear reciprocating movement between the first position P1 and the second position P2 (i.e., the front side of the washing tub 30) to reflect the washing water.

Next, as a fourth case (Case 4), a case in which dishes are stored in the diagonal areas a1 and a4 or a2 and a3 among the plurality of dish storage areas a1, a2, a3, and a4 will be described.

When the dishes are housed in the first area a1 and the fourth area a4 of the plurality of dish storage areas a1, a2, a3 and a4 (Case 4-1), the controller 730 drives the driving unit 750 to control the lower right nozzle 340 to spray the washing water and the vane 400 to perform a linear reciprocating movement between the first position P1 and the third position P3 (i.e., the front side of the washing tub 30) after driving the driving unit to control the lower left nozzle 330 to spray the washing water and the vane 400 to perform a linear reciprocating movement between the second position P2 and the third position P3 (i.e., the rear side of the washing tub 30).

Conversely, the controller 730 may wash the fourth area a4 first and then the first area a1 later.

Also, when the dishes are housed in the second area a2 and the third area a3 of the plurality of dish storage areas a1, a2, a3 and a4 (Case 4-2), the controller 730 drives the driving unit 750 to control the lower right nozzle 340 to spray the washing water and the vane 400 to perform a linear reciprocating movement between the second position P2 and the third position P3 (i.e., the front side of the washing tub 30) after driving the driving unit to control the lower left nozzle 330 to spray the washing water and the vane 400 to perform a linear reciprocating movement between the first position P1 and the second position P2 (i.e., the rear side of the washing tub 30).

Conversely, the controller 730 may wash the third area a3 first and then the second area a2 later.

Next, as a fifth case (Case 5), a case where dishes are stored in three areas among the plurality of dish storage areas a1, a2, a3 and a4 will be described.

When the dishes are housed in the first area to the third area a1, a2, and a3 of the plurality of dish storage areas a1, a2, a3 and a4 (Case 5-1), the controller 730 drives the driving unit 750 to control the lower left nozzle 330 to spray the washing water to wash the first area a1 and the third area a3 first and the vane 400 performs a linear reciprocating movement between the second position P2 and the third position P3 (i.e., the front side of the washing tub 30), and then the controller 730 drives the driving unit 750 to control the lower right nozzle 340 to spray the washing water and the vane 400 to perform a linear reciprocating movement between the second position P2 and the third position P3 (i.e., the rear side of the washing tub 30) to wash the second area a2.

Conversely, the controller 730 may wash the second area a2 first, and then the first area a1 and the third area a3 later.

Also, when the dishes are housed in the first area a1, the third area a3, and the fourth area a4 of the plurality of dish storage areas a1, a2, a3 and a4 (Case 5-2), the controller 730 drives the driving unit 750 to control the lower left nozzle 330 to spray the washing water to wash the first area a1 and the third area a3 first and the vane 400 performs a linear reciprocating movement between the first position P1 and the second position P2 (i.e., the front side and the rear side of the washing tub 30), and then the controller 730 drives the driving unit 750 to control the lower right nozzle 340 to spray the washing water and the vane 400 to perform a linear reciprocating movement between the first position P1 and the third position P3 (i.e., the rear side of the washing tub 30) to wash the fourth area a4.

Conversely, the controller 730 may wash the fourth area a4 first, and then the first area a1 and the third area a3 later.

Also, when the dishes are housed in the first area a1, the second area a2, and the fourth area a4 of the plurality of dish storage areas a1, a2, a3 and a4 (Case 5-3), the controller 730 drives the driving unit 750 to control the lower left nozzle 330 to spray the washing water to wash the first area a1 and the vane 400 performs a linear reciprocating movement between the second position P2 and the third position P3 (i.e., the front side and the rear side of the washing tub 30), and then the controller 730 drives the driving unit 750 to control the lower right nozzle 340 to spray the washing water and the vane 400 to perform a linear reciprocating movement between the first position P1 and the third position P3 (i.e., the rear side of the washing tub 30) to wash the second area a2 and the fourth area a4.

Conversely, the controller 730 may wash the second area a4 and the fourth area a4 first, and then the first area a1.

Also, when the dishes are housed in the second area a2, the third area a3 and the fourth area a4 of the plurality of dish storage areas a1, a2, a3 and a4 (Case 5-4), the controller 730 drives the driving unit 750 to control the lower left nozzle 330 to spray the washing water to wash the first area a1 and the vane 400 performs a linear reciprocating movement between the first position P1 and the third position P3 (i.e., the front side of the washing tub 30), and then the controller 730 drives the driving unit 750 to control the lower right nozzle 340 to spray the washing water and the vane 400 to perform a linear reciprocating movement between the first position P1 and the second position P2 (i.e., the front side and the rear side of the washing tub 30) to wash the second area a2 and the fourth area a4.

Conversely, the controller 730 may wash the second area a4 and the fourth area a4 first, and then the third area a3 later.

Next, a sixth case (Case 6) will be described in which dishes are stored in all of the plurality of dish storage areas a1, a2, a3, and a4.

In the case where the dishes are stored in all of the plurality of dish storage areas a1, a2, a3, and a4 (case 6), the controller 730 controls the driving unit 750 to spray the washing water from the lower left nozzle 330 and the lower right nozzle 340, and the vane 400 is moved between the first position P1 and the second position P2 (the front side and the rear side of the washing tub 30).

On the other hand, in a seventh case (Case 7), when dishes are not stored in the plurality of dish storage areas a1, a2, a3 and a4, the controller 730 does not perform the cleaning control for the lower basket 12*b*.

Meanwhile, the dish washing machine 1 according to the embodiment can perform washing control on the upper basket 12*a* as well. FIG. 19 is a schematic view for explaining a method of performing washing control according to whether dishes are placed in an upper basket or the lower basket.

The controller 730 of the dish washing machine 1 according to the embodiment can determine that the dishes are housed in the upper basket 12*a* when it is determined that the upper basket 12*a* has been carried in after the upper basket 12*a* has been taken out. However, whether the lower basket 12*b* is filled with dishes can be determined by detecting a covered portion of the door identifier 14 described above.

In the first case (Case 1), when it is determined that the dishes are not stored in both the upper basket 12*a* and the lower basket 12*b*, the controller 730 does not perform the washing control.

In the second case (Case 2), when it is determined that the dishes are stored in the upper basket 12*a*, and determined that the dishes are not stored in the lower basket 12*b*, the controller 730 may control the driving unit 750 such that the upper nozzle 311 and the intermediate nozzle 313 spray the washing water into the upper basket 12*a*.

In the third case (Case 3), when it is determined that the dishes are not stored in the upper basket 12*a*, and determined that the dishes are stored in the lower basket 12*b*, the controller 730 may control the driving unit 750 to perform the washing control for each of the dish storage areas of the lower basket 12*b* as described in FIG. 18.

Lastly, in the fourth case (Case 4), when it is determined that the dishes are all stored in the upper basket 12*a* and the lower basket 12*b*, the controller 730 may control the driving unit 750 such that the upper nozzle 311 and the intermediate nozzle 313 spray the washing water into the upper basket 12*a*, and may control the driving unit 750 to perform the washing control for each of the dish storage areas of the lower basket 12*b* as described in FIG. 18.

Although the above embodiment has been described by way of example in which the dish storage area of the lower basket 12*b* is divided and the washing water is supplied to each of the areas of the lower basket 12*b*, the upper basket 12*a* is also divided into areas, and the washing water can be supplied to each of the areas.

Furthermore, although not shown, the dish washing machine 1 may further include a contamination degree detecting sensor for detecting the degree of contamination of the dishes, and the contamination degree detecting sensor may be provided inside the washing tub 30.

When the dish washing machine 1 senses the degree of contamination for each of the upper basket 12*a* and the lower basket 12*b* and senses the degree of contamination for each of the dish storage areas of the lower basket 12*b*, the controller 730 controls the basket 12*a*, and the execution time of the washing process may be set differently according to the degree of contamination of the dish storage area.

In the case where the dish washing machine 1 according to the embodiment of the present disclosure supplies washing water to the area in which the dishes are placed, the washing water is supplied intensively to the area where the dishes are placed in the process of supplying the washing water such as washing or rinsing such that the washing power of the dishes can be increased, and as the washing water is selectively supplied to the area in which the dishes are placed, the execution time of the process such as washing or rinsing can be shortened.

Hereinafter, an embodiment relating to a method of controlling the dish washing machine will be described. The dish washing machine 1 according to the above-described embodiment can be applied to the control method of the dish washing machine. Therefore, the above description of the dish washing machine 1 can also be applied to the control method of the dish washing machine.

Figure 20:
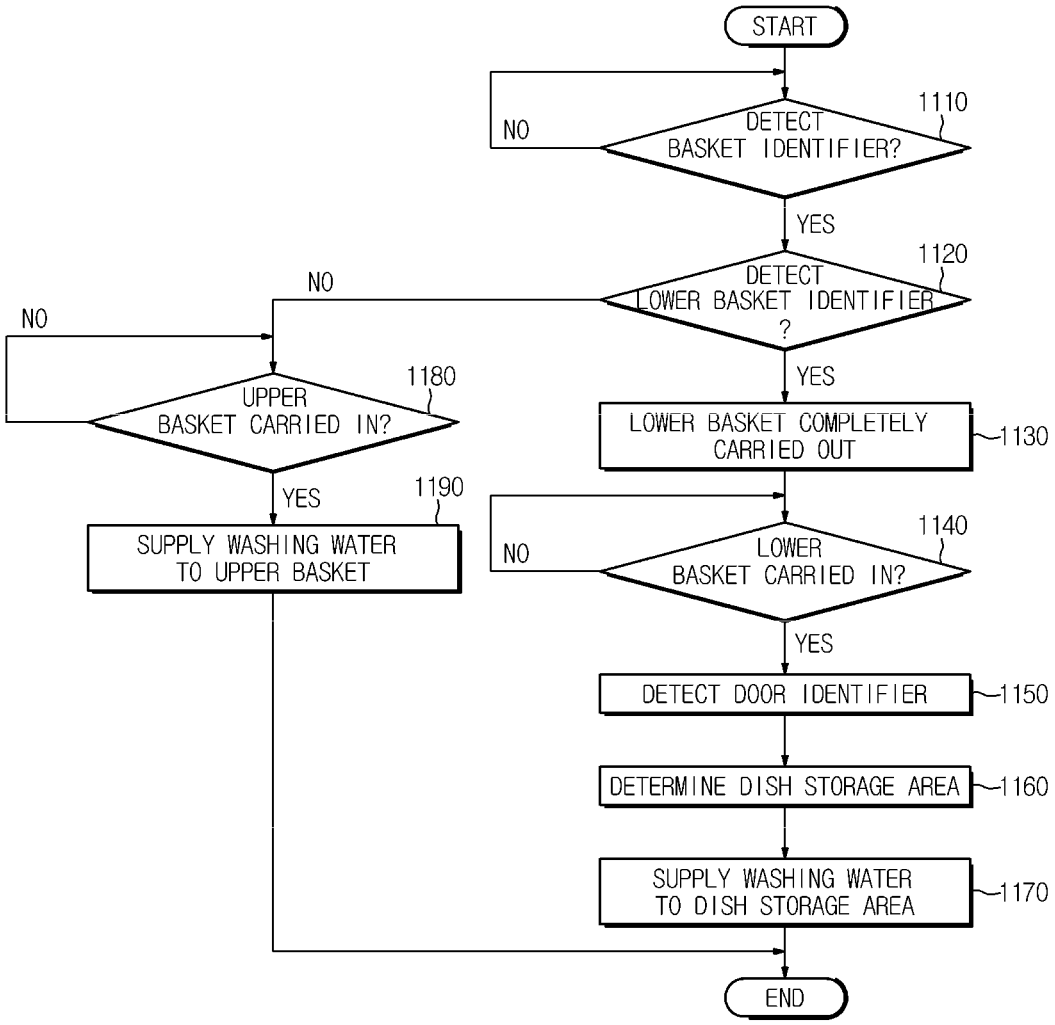
FIG. 20 is a flowchart of a method of supplying washing water to the dish storage area of a controlling method of the dish washing machine in accordance with an embodiment of the disclosure.

FIG. 20 is a flowchart of a method of supplying washing water to the dish storage area of a controlling method of the dish washing machine in accordance with an embodiment of the disclosure.

When the sensing unit 720 senses at least one of the upper basket identifier 15*a* and the lower basket identifier 15*b* (YES in 1110), the controller 730 can determine whether the upper basket 12*a* or the lower basket 12*b* is taken out based on the detection result of the sensing unit 720. For example, if the identifier 15*a* of the upper basket 12*a* and the identifier 15*b* of the lower basket 12*b* have different colors or different patterns, the sensing unit 720 may determine whether the upper basket 12*a* or the lower basket 12*b* is taken out by distinguishing the identifier 15*a* of the upper basket 12*a* and the identifier 15*b* of the lower basket 12*b*.

If the lower basket identifier 15*b* is detected (YES in 1120) and the lower basket identifier 15*b* exists at a predetermined distance from the door 11, it can be determined that the lower basket 12*b* is completely taken out (1130).

If it is determined that the lower basket identifier 15*b* moves in the direction close to the door 11 and the lower basket 12*b* starts to be carried in (YES in 1140), the area in which the dishes are placed in the lower basket 12*b* is determined based on the detection result of the door identifier 14 and the lower basket identifier 15*b* of the sensing unit 720.

And, if the lower basket identifier 15*b* detected by the sensing unit 720 is no longer detected (that is, when the lower basket 12*b* is fully carried in), the controller 730 controls the washing water to supply the washing water in the determined dish storage area. In this case, the driving unit 750 drives the distribution device 200 to supply the washing water to at least one of the lower left nozzle 330 and the lower right nozzle 340 corresponding to the dish storage area, and drives the vane 400 to perform a linear reciprocating movement along the front-rear direction of the washing tub 30 at a position corresponding to the dish storage area.

On the other hand, if the identifier 15*a* of the upper basket 12*a* is detected (NO in 1120) and it is determined that the upper basket 12*a* is carried in after the upper basket identifier 15*a* is taken out based on the detection result of the sensing unit 720, the controller 730 may control the driving unit 750 to supply the washing water to the distribution device 200 through the intermediate nozzle 313 to the upper basket 12*a*.

Hereinafter, the specific steps of the method (1160) of determining the area of the dishes placed in the lower basket 12*b* based on the detection result of the door identifier 14 and the lower basket identifier 15*b* of the sensing unit 720 will be described.

Figure 21:
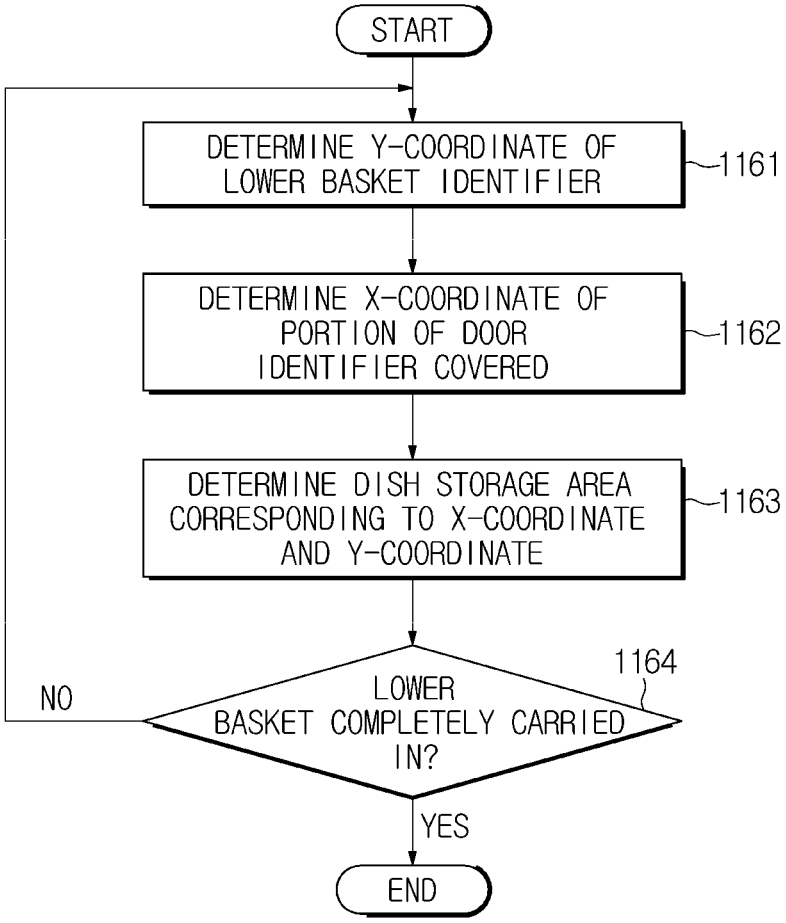
FIG. 21 is a flowchart of a method of determining the dish storage area of the controlling method of the dish washing machine in accordance with an embodiment of the disclosure.

FIG. 21 is a flowchart of a method of determining the dish storage area of the controlling method of the dish washing machine in accordance with an embodiment of the disclosure.

First, the controller 730 determines the coordinates of the lower basket identifier 15*b* (1161). Here, the coordinates of the lower basket identifier 15*b* may be a y-coordinate indicating the distance from the rear end of the door 11 (i.e., from the front opening of the washing tub 30 to the lower basket identifier 15*b*.

Then, the controller 730 determines the coordinates of the portion where the door identifier 14 is covered by the dishes (1162). Here, the coordinates of the portion where the door identifier 14 is covered may be the x-coordinate indicating the shortest distance and the longest distance from the right end of the door 11 to the portion where the door identifier 14 is covered, and the controller 730 may determine the width of the portion where the door identifier 14 is covered using the difference between the shortest distance and the longest distance to the portion where the door identifier 14 is covered.

Then, the controller 730 determines (1163) the dish storage area based on the y-coordinate of the lower basket identifier 15*b* and the x-coordinate of the portion where the door identifier 14 is covered. As for the method of determining the dish storage area based on the x-coordinate and the y-coordinate, the repeated description will be omitted.

The controller 730 may perform the coordinate determination of the lower basket identifier 15*b* and the coordinate determination of the portion where the door identifier 14 is covered by the lower basket 12*b* in real time until the lower basket 12*b* is completely carried in (1160).

In FIG. 21, the coordinates of the lower basket identifier 15*b* are first determined (1161), and then the coordinates of the portion where the door identifier 14 is covered is determined (1162), but the order is not limited thereto.

Although a few embodiments of the present disclosure have been shown and described, it would be appreciated by those skilled in the art that changes may be made in these embodiments without departing from the principles and spirit of the disclosure, the scope of which is defined in the claims and their equivalents.

DESCRIPTION OF SYMBOLS

1: dish washing machine
51: circulation pump
52: drain pump
49: wash supply pump
710: input unit
720: sensing unit
730: controller
740: memory
750: driving unit
200: distribution device
400: vane

The invention claimed is:

1. A dish washing machine, comprising:

a door having a door identifier attached thereto;

a washing tub having a front opening that is opened and closed by the door;

a main body in which the washing tub is provided;

a basket installed to move into and out of the washing tub to accommodate dishes and having a basket identifier thereto;

a sensing unit configured to sense the basket identifier and the door identifier;

a plurality of nozzles configured to spray washing water;

a vane configured to reflect the sprayed washing water in the washing tub;

a driving unit configured to drive the vane; and a controller configured to control the driving unit such that cleaning is performed for each dish storage area of the basket based on the sensed result of the sensing unit, wherein the controller determines an area in which the dishes are accommodated, and controls the driving unit to clean the dish storage area in which the dishes are accommodated, the sensing unit includes a camera provided at an upper end of the main body to take a picture of a front of the main body, the controller generates position information of the basket identifier and position information of a blocked portion of the door identifier based on the sensed result of the sensing unit, the position information of the blocked portion of the door identifier includes x-axis coordinates from one end of the door to the blocked portion of the door identifier, the position information of the basket identifier includes a v-axis coordinate indicating a distance from a front opening of the washing tub to the basket identifier, and the position information of the door identifier includes width information of the blocked portion of the door identifier.

2. The dish washing machine of claim 1, wherein the basket identifier and the door identifier each include a color or a pattern distinguished by the controller.

3. The dish washing machine of claim 1, wherein the basket identifier is provided in front of the basket, wherein the door identifier is provided on an inner side surface of the door.

4. The dish washing machine of claim 1, wherein the controller determines a plurality of the dish storage areas in which dishes are accommodated.

5. The dish washing machine of claim 1 further comprising:

a sump configured to store the washing water; and a dispensing device configured to supply the washing water stored in the sump to the plurality of nozzles, wherein the driving unit drives the dispensing device according to a control signal of the controller, and the controller controls the driving unit such that a nozzle corresponding to the dish storage area in which the dishes are accommodated among the plurality of nozzles sprays the washing water to the dish storage area in which the dishes are accommodated.

6. The dish washing machine of claim 1, wherein the plurality of nozzles are fixed to a lower side of the washing tub, wherein the vane performs a linear reciprocating motion along the spraying direction of the plurality of nozzles according to the driving of the driving unit.

7. The dish washing machine of claim 1, wherein the basket includes an upper basket and a lower basket, the upper basket and the lower basket have basket identifiers, respectively, that are distinguished from each other, the sensing unit senses the basket identifier of the upper basket and the basket identifier of the lower basket, and the controller determines whether the upper basket is inserted into or withdrawn out based on the result of sensing the basket identifier of the upper basket and determines whether the lower basket is inserted into or withdrawn out based on the result of sensing the basket identifier of the lower basket.

8. The dish washing machine of claim 1, wherein the controller determines the dish storage area in which the dishes are accommodated when the basket is inserted into the washing tub.

* * * * *